US007370940B2

(12) United States Patent
Hashimoto

(10) Patent No.: US 7,370,940 B2
(45) Date of Patent: May 13, 2008

(54) LIQUID EJECTION HEAD HAVING IMPROVED DURABILITY AGAINST LIQUID, LIQUID CARTRIDGE HAVING SUCH A LIQUID EJECTION HEAD, LIQUID EJECTION APPARATUS HAVING SUCH A LIQUID CARTRIDGE, IMAGE FORMING APPARATUS HAVING SUCH A LIQUID EJECTION APPARATUS, AND MANUFACTURING METHOD OF LIQUID EJECTING HEAD

(75) Inventor: Kenichiroh Hashimoto, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 282 days.

(21) Appl. No.: 10/549,788

(22) PCT Filed: Feb. 2, 2005

(86) PCT No.: PCT/JP2005/001863

§ 371 (c)(1),
(2), (4) Date: Sep. 19, 2005

(87) PCT Pub. No.: WO2005/075200

PCT Pub. Date: Aug. 18, 2005

(65) Prior Publication Data

US 2007/0165078 A1 Jul. 19, 2007

(30) Foreign Application Priority Data

Feb. 9, 2004 (JP) ..... 2004-031686

(51) Int. Cl.
*B41J 2/04* (2006.01)

(52) U.S. Cl. ..... 347/54; 347/56; 347/65

(58) Field of Classification Search ..... 347/20, 347/54, 56, 61–65, 67; 29/611, 890.1
See application file for complete search history.

(56) References Cited

U.S. PATENT DOCUMENTS

| | | | | |
|---|---|---|---|---|
| 4,723,129 | A | 2/1988 | Endo et al. | 347/56 |
| 6,277,294 | B1 | 8/2001 | Ozaki et al. | 216/27 |
| 6,464,342 | B1 * | 10/2002 | Kubota et al. | 347/63 |
| 6,682,185 | B2 | 1/2004 | Hashimoto et al. | 347/56 |

FOREIGN PATENT DOCUMENTS

| | | |
|---|---|---|
| JP | 9-216367 | 8/1997 |
| JP | 11-48483 | 2/1999 |
| JP | 11-170546 | 6/1999 |
| JP | 2000-225703 | 8/2000 |
| JP | 2001-18385 | 1/2001 |
| JP | 2001-260367 | 9/2001 |
| JP | 2001-328263 | 11/2001 |
| JP | 2002-29048 | 1/2002 |
| JP | 2002-36541 | 2/2002 |
| JP | 2002-67307 | 3/2002 |
| JP | 2002-144589 | 5/2002 |
| JP | 2002-166559 | 6/2002 |
| JP | 2002-292868 | 10/2002 |

* cited by examiner

*Primary Examiner*—Juanita D. Stephens
(74) *Attorney, Agent, or Firm*—Cooper & Dunham, LLP

(57) ABSTRACT

A liquid ejection head includes therein a movable member, wherein the movable member is formed of lamination of at least three layers, at least one layer thereof having a free edge part covered with another layer.

21 Claims, 13 Drawing Sheets

LIQUID EJECTION HEAD HAVING IMPROVED DURABILITY AGAINST LIQUID, LIQUID CARTRIDGE HAVING SUCH A LIQUID EJECTION HEAD, LIQUID EJECTION APPARATUS HAVING SUCH A LIQUID CARTRIDGE, IMAGE FORMING APPARATUS HAVING SUCH A LIQUID EJECTION APPARATUS, AND MANUFACTURING METHOD OF LIQUID EJECTING HEAD

TECHNICAL FIELD

The present invention relates to a liquid ejection head, liquid cartridge, liquid ejection apparatus and image forming apparatus, and manufacturing method of a liquid electing head.

BACKGROUND ART

An ink-jet recording apparatus includes a liquid ejection apparatus that uses a liquid ejection head for an ink-jet recording head. An ink-jet recording apparatus has been used extensively as an image forming apparatus of printers, facsimile machines, copiers or compound machines of these. Here, it should be noted that an ink-jet recording apparatus is defined as an apparatus that records images on a sheet (not limited to paper but includes also OHP sheet or any other medium on which ink droplets or other liquids can be attached and is called also as recording medium, recorded medium or recording sheet) by way of an ink recording head. Thereby, an ink-jet recording apparatus is capable of recording high-definition color images on such a medium with high speed.

Because such ink-jet recording apparatuses are marketed with low price, and further in view of its capability of providing high image quality particularly when used with a dedicated sheet, spreading of ink-jet recording apparatuses has been started in relation to the personal use applications. On the other hand, ink-jet recording apparatuses are used nowadays also in offices, in which laser printers of electrophotographic principle have been used conventionally, as the recording apparatus that is capable of achieving color output.

For the liquid ejection head, such as an ink-jet head used for an ink-jet recording apparatus, a thermal head that includes therein an ejecting port for ejecting the liquid in the form of droplet, a liquid passage communicating with the foregoing ejecting port, and an electro-thermal converter (heater) that provides energy for ejecting the liquid in the ink filling the passage, has been used. There, the energy provided to the liquid in the passage cause formation of bubbles in the liquid, and the dilatational force associated with the formation of the bubbles causes the ejection of the liquid droplets from the foregoing ejecting port.

Patent Reference 1: U.S. Pat. No. 4,723,129

Because the thermal head can record high-quality images at high speed with low cost, and because of its construction suitable for arranging the ink ejecting ports with high density, a thermal head has various advantageous features in that it can be used with a compact apparatus for forming high definition recording images including color images. Thus, thermal heads are used these days in numerous office apparatuses such as printers, copiers, facsimile machines, and the like. Further, a thermal head is now used also in industrial systems including textile printing apparatuses.

With such wide spread use of thermal head in various applications and various products, there also arise versatile demands and desires, and in order to meet for such demands and desires, various proposals have been made such as driving of the thermal head under a drive condition that enables high ejecting speed for the liquid droplets with stable bubble formation for achieving high quality images, or improvement of the shape of the liquid passage from the viewpoint of high-speed recording so as to enable high-speed filling of the ink in the liquid passage and hence realizing a high-speed liquid ejection head.

With the thermal head of the type that forms bubbles in the liquid passage and causes the ejection of the liquid droplets with the dilatation of the bubbles, it is known that the dilatation of the bubble in a reverse direction away from the ejecting outlet, and associated reverse flow of the liquid, becomes the factor of decreasing the ejection energy of the droplets and further the factor of decreasing of the refill characteristics.

In view of the foregoing problem, Japanese Laid-Open Patent Application 2000-225703 proposes a structure for improving the ejecting energy efficiency and the ink refill characteristics of such a liquid ejection head.

Patent Reference 2: Japanese Laid-Open Patent Application 2000-225703

It should be noted that the invention disclosed in Patent Reference 2 discloses a construction in which there is provided a movable member between the liquid passage and a common liquid supply chamber communicating with the liquid passage so as to interrupt the communication therebetween.

According to Reference 2, the movable member has a laminated structure, wherein the outer periphery (free end part) of the movable member has a sawtooth form in the thickness direction thereof. Here, it should be noted that the representation "sawtooth structure in the thickness direction" means that the cross-sectional area and hence the peripheral length in the cross section taken in the thickness direction of the movable member, are changed alternately between "large" and "small", such as "large" to "small" to "large".

Further, Patent Reference 3 discloses an electrostatic ink-jet head, wherein the reference proposes a construction in which ink is supplied through an electrode substrate formed with individual electrodes. In the construction of the ink-jet head of Patent Reference 3, there is provided a movable member (check valve) in the ink supply passage to each liquid chamber by the extension part of a diaphragm.

Patent Reference 3: Japanese Laid-Open Patent Application 2001-18385

DISCLOSURE OF THE INVENTION

With the liquid ejection head of Patent Reference 1, the edge of the movable member is formed to have a sawtooth shape in the thickness direction at the free end part thereof, and thus, the foregoing plural layers constituting the movable member make a contact with the liquid at the foregoing free end part. In the art of ink-jet recording apparatus, it is generally practiced to use an alkaline ink for the ink to be ejected, while the use of such alkaline ink leads to the problem that the material contacting with the ink tends to undergo corrosion. Thus, ink-durability of the material used for the movable member is an important factor in the art of ink-jet head.

Thus, it is important with such an ink-jet head to develop the material of the liquid ejection head that is resistant against corrosion caused by the ink, or to find out the ink composition that does not cause corrosion in the ink ejection head. However, development of such ink that does not cause corrosion over wide spectrum of materials is a difficult task. In addition to the foregoing, the ink for an ink-jet recording apparatus is required, in order to achieve high quality image recording, to satisfy the demand with regard to the durability for the recording medium on which the recording is made with the ink and further to satisfy the demand of durability for the material of the plural layers constituting the movable member that makes a contact with the ink.

Further, in the case a liquid other than ink is used for the liquid with such liquid ejection head, as in the case of fabricating DNA chips, formation of metal interconnections, formation of color filters, or the like, various solvents are used with the liquid, and it becomes extremely difficult to satisfy the condition of durability for the material of the liquid ejection head with regard to the liquid used therewith.

Further, in the case there is formed the foregoing sawtooth part at the free edge part of the movable member, there is inevitably formed a part of extremely reduced thickness (the part formed of only one layer) in such a structure, while such a part of reduced thickness easily undergoes cracking or chipping with the mechanical shock associated with formation or annihilation of bubbles. Thereby, there may be caused problems such as unstable ejection of the liquid droplets between different channels or choking or clogging of the liquid ejecting port or the liquid passage caused by the chipped fragments. Any of these can result in deterioration of the printing quality.

Further, corrosion of the movable member may be caused also in a part thereof at the time of an etching process used for forming a space underneath the movable member as a result of the corrosion action of the etching gas or etchant used for etching process, which is used for etching a sacrifice layer provided underneath the movable member in correspondence to the space to be formed.

On the other hand, when a material not causing corrosion at the time of such an etching process of the sacrificing layer is chosen for the layers constituting the movable member, it becomes difficult to choose the material for the sacrifice layer or the etching gas or etchant. Further, it is difficult to choose the material of the layers constituting the movable members. Thereby, it becomes difficult to design a workable movable member in terms of Young modulus, internal stress, and the like.

The present invention has been made in view of the foregoing problems and has its object of providing a liquid ejection head in which the degree of freedom for the selection of the liquid used with the head is increased or in which the degree of freedom for the selection of the material forming the movable member used in the head is increased. Further, the present invention provides a liquid ejection head in which instability of ejecting characteristics or defective ejecting is suppressed and the quality of the pattern formed on a medium is improved. In addition, the present invention provides a liquid ejection head in which the efficiency of liquid ejection is improved. Further, the present invention provides a liquid cartridge, liquid electing apparatus and image forming apparatus, and manufacturing method of a liquid ejection head.

In order to solve the foregoing problem, the present invention provides, in a first aspect thereof, a liquid ejection head including therein a movable member, wherein the movable member is formed of lamination of at least three layers, at least one layer thereof having a free edge part covered with another layer.

In another aspect, the present invention provides a liquid ejection head including therein a movable member, wherein the movable member is formed of lamination of at least three layers made of at least two, different materials, at least one layer thereof having a free edge part covered with a layer constituting a surface of said movable member.

In another aspect, the present invention provides a liquid ejection head including therein a movable member, wherein the movable member is formed of lamination of two or more layers made of two different materials, a free edge surface of the movable member being covered with the layer of an odd number as counted from a device substrate In another aspect, the present invention provides a liquid ejection head including therein a movable member, wherein the movable member is formed of lamination of three or more layers made of three, different materials, a free edge surface of the movable member being covered with a layer of a material identical with the first layer thereof as counted from a device substrate.

In another aspect, the present invention provides a liquid ejection head including therein a movable member, wherein the movable member is formed of lamination of two or more layers made of two or more materials, a free edge surface of the movable member forming a flat surface.

In another aspect, the present invention provides a liquid ejection head including therein a movable member, wherein the movable member has a construction of having initial flexure at a side opposite to an heating element.

In another aspect, the present invention provides a liquid cartridge having a construction in which any of the liquid ejection head of the present invention is integrated with a liquid container holding a liquid to be supplied to the liquid ejection head.

In another aspect, the present invention provides a liquid ejection apparatus that uses any of the liquid ejection heads of the present invention or the liquid cartridge of the present invention.

In another aspect, the present invention provides an image forming apparatus equipped with any of the liquid ejection head of the present invention or the liquid cartridge of the present invention.

Further, in another aspect of the present invention, there is provided a manufacturing method of a liquid ejection head including therein a movable member having a laminated construction, according to the steps of: forming, at the time of laminating plural layers to form the movable member, a part in which two or more layers of the same materials are laminated in direct contact therebetween, and etching the foregoing part in which two or more layers of the same material are laminated in direct contact therebetween.

BEST MODE FOR CARRYING OUT THE INVENTION

Hereinafter, the present invention will be described in terms of the embodiments thereof with reference to the attached drawings.

First Embodiment

Figure 1:
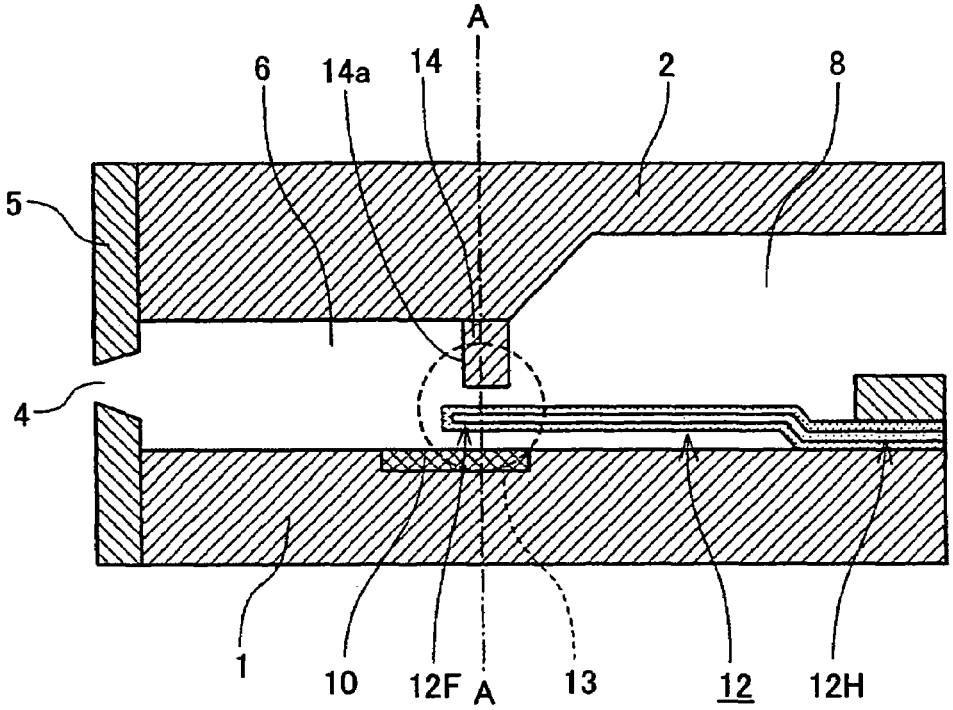
FIG. 1 is a cross-sectional diagram explaining the construction of a liquid ejection head according to a first embodiment of the present invention.
Figure 2:
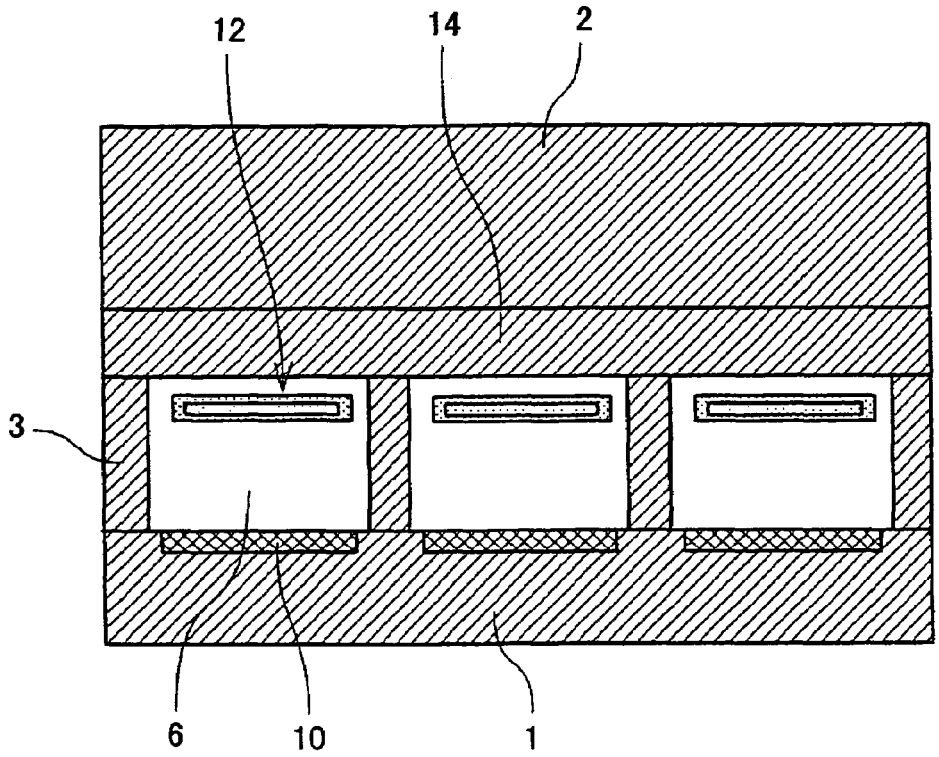
FIG. 2 is a cross-sectional diagram taken along an A-A line of FIG. 1.
Figure 3:
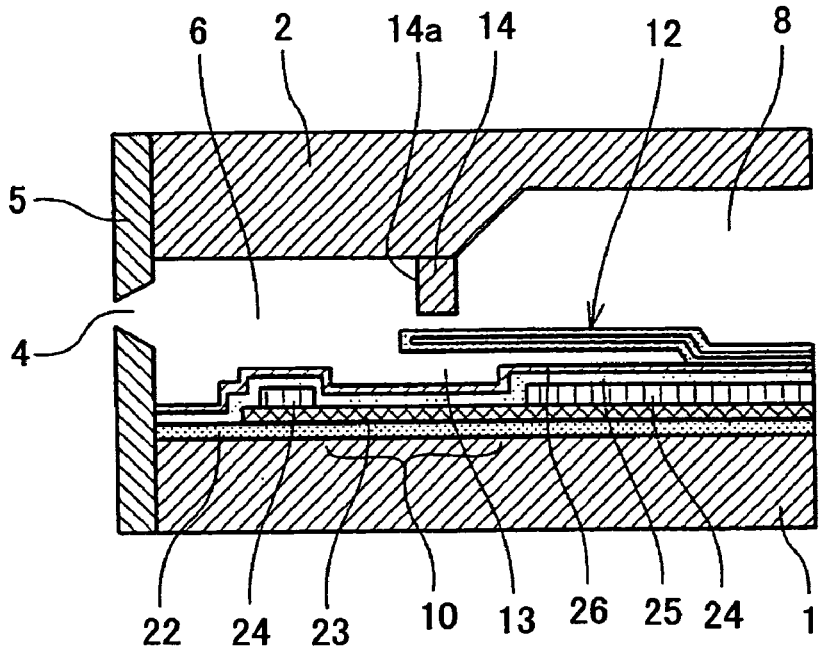
FIG. 3 is a cross-sectional diagram explaining the details of the device substrate of the liquid ejection head of FIG. 1.
Figure 4:
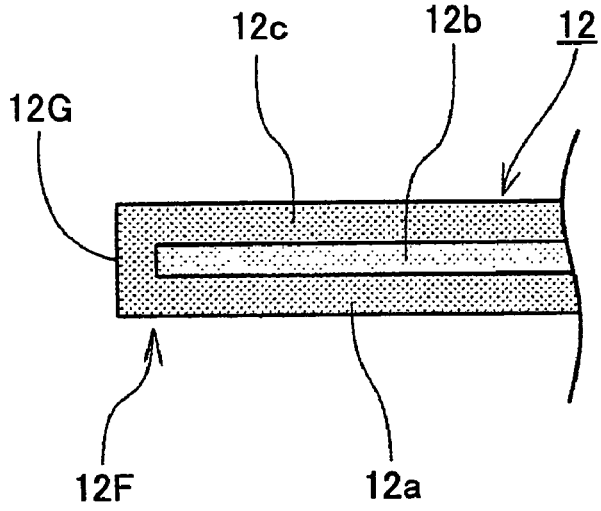
FIG. 4 is a cross-sectional diagram explaining the details of a movable member used with the liquid ejection head of FIG. 1.

First, a first embodiment of the liquid ejection head of the present invention will be described with reference to FIGS. 1-3, wherein it should be noted that FIG. 1 is a cross-sectional diagram of the liquid ejection head, while FIG. 2 is a cross-sectional diagram taken along A-A line of FIG. 1. FIG. 3 is a cross-sectional diagram showing an example of the device substrate of the liquid ejection head, while FIG. 4 is an enlarged view diagram of a movable member of the head.

Referring to the drawings, the liquid ejection head includes a device substrate 1 and a top plate 2 forming therebetween a plurality of flow passages 6 such that the flow passages 6 are separated from each other by separation walls 3. Each of the flow passages 6 communicates with a corresponding ejection port 4 formed in a nozzle plate 5 directly, wherein the foregoing plural flow passages 6 are communicated with a common liquid supply chamber 8 of large volume formed between the device substrate 1 and the top plate 2 so as to supply a liquid to the respective flow passages 6.

Thus, there extend a large number of flow passages 6 from the single common liquid supply chamber 8, and the common liquid supply chamber 8 replenishes the liquid with the amount corresponding to the liquid ejected from the ejection port 4.

Further, the device substrate 1 is provided with a heating body (heating means, heating part) 10 in each of the flow passages 6, such as an electro-thermal conversion element, as the means of forming bubbles in the liquid filling the flow passage 6. Thus, in the vicinity of the region in which the heating body 10 makes a contact with the liquid, there is formed a bubble formation region 11, in which region there occurs bubble formation in the liquid to be ejected in response to rapid heating of the heating body 10.

For example, this device substrate 1 has a construction shown in FIG. 3, in which there is formed an insulation film 22 of silicon oxide or silicon nitride on a base 21 of silicon, or the like, for the purpose of insulation and heat accumulation, and the heating body 10 is formed thereon by patterning a resistance layer 23 of hafnium boride ($HfB_2$), tantalum nitride (TaN), tantalum aluminum (TaAl), or the like (0.01-0.2 μm in thickness), wherein interconnection electrodes 24 of aluminum, or the like (0.2-1.0 μm in thickness) are formed further for the purpose of feeding driving power to the heating body 10. The heating body 10 is thereby activated by applying a voltage to the resistance layer 23 via the interconnection electrodes 24.

On the resistance layer 23, there is formed a protective film 25 of silicon oxide, silicon nitride, or the like, between the interconnection electrodes 24 with the thickness of 0.1-2.0 μm, and an anti-cavitation layer 26 of tantalum is formed further thereon (0.1-0.6 μm in thickness) so as to protect the resistance layer 23 from various liquids such as ink.

It should be noted that the anti-cavitation layer 26 is formed of a metal such as tantalum (Ta) because there can be induced a very large pressure change in the form of shockwave at the time of formation or annihilation of bubble in such a liquid ejection head. Such large pressure change or shockwave can cause severe degradation in the durability of hard and brittle oxide film. Depending on the combination of the liquid, construction of the flow passages, and further the resistance material, it may be possible to eliminate the protection film 25 of the resistance layer 23.

In each of the embodiments described heretofore or to be described hereinafter, the heating body 10 is provided by the one that uses the resistance layer 23, which causes heat generation in response to an electric driving current. However, the present invention is not limited to such a specific construction, but it is also possible to use any element that can cause formation of bubble sufficient for causing droplet ejection in the liquid. For example, it is possible to use a heating element that includes an opto-thermal converter that generates heat upon irradiation with light such as a laser beam. Alternatively, it is possible to use a heater generating heat upon irradiation with high frequency radio wave.

Further, it should be noted that the device substrate 1 may carry, in addition to the heating body 10 including therein the resistance layer 23 constituting the heat generation part and the interconnection electrodes 24 for supplying electric signals to the resistance layer 23, various functional elements such as transistors, diodes, latches, shift registers, or the like, formed by a semiconductor fabrication process, for the purpose of selective driving of the heating body 10.

In this liquid ejection head, there is further provided a movable member 12 between the common liquid supply chamber 8 and the liquid flow passage 6 in each of the liquid flow passages 6, such that the movable member 12 has a first end 12H fixed upon the device substrate 1 and a free end 12F at the opposite end thereof close to the ejection port 4. Thereby, the movable member 12 is provided on the device substrate 1 like a cantilever beam at the location corresponding to the heating body 10 such that there is formed a gap 13 between the movable member 12 and the device substrate 1.

With this, the movable member 12 is mounted in a manner that the free end 12F is movable in the upward and downward directions. Further, there is provided a stopper 14 in the top plate 2 for restricting the displacement of the movable member 12 in the upward direction.

In the initial state (stationary state), the movable member 12 is provided generally parallel with the device substrate 1, and the gap 13 is formed between the movable body 12 and the device substrate 1. Thereby, the movable member 12 is disposed such that the free end 12F thereof is located generally at the central part of the heating body 10 provided on the device substrate.

The stopper 14 is provided on the lower surface of the top plate 2 as a unitary body or a separate body attached thereto, wherein the stopper 14 restricts the displacement of the free end 12F of the movable member 12 by making engagement therewith. Thereby, the movable member 12 disconnects the downstream side of the flow passage 6 from the upstream side of the flow passage 6 in cooperation with the stopper part 14 in the activated sate thereof when movable part had made engagement with stopper 14.

Further, it should be noted that the wall surface 14*a* of the stopper 14 at the side of the flow passage 6 rises vertically in the illustrated construction, and thus, the height of the flow passage 6 at the downstream side of the stopper 14 increases sharply. With such a construction, the bubble 15 formed in the downstream side of the bubble forming region can grow without being hampered, even in the case the movable member 12 is engaged with the stopper part 14, because of the sufficient height of the liquid flow passage 6, and the bubble thus grown is moved smoothly toward the liquid ejection port 4. Further, the pressure difference of the liquid at the ejection port 4 in the height direction is reduced with such a construction, and it becomes possible to achieve stable ejection of liquid droplets.

Here, it should be noted that the movable member 12 is formed of three or more layers, and the edge part of the free end 12F, including the surface part thereof, is covered with the layer that constitutes the surface of the movable member 12. Hereinafter, explanation will be made for the case in which the movable member 12 is formed of lamination of three layers.

In such a construction, the movable member 12 is a member in which three layers 12*a*, 12*b* and 12*c* are laminated as shown in FIG. 5, wherein the layers 12*a* and 12*c* are formed of silicon nitride while the layer 12*b* is formed of silicon oxide. Thereby, the peripheral part of the movable member 12, including the edge part of the free end 12F of the movable member 12, is covered with the layer 12*a* or 12*c* of silicon nitride, and thus, the silicon oxide film constituting the intermediate layer 12*b* is not exposed. Further, it should be noted that the edge surface 12G of the foregoing free end 12F of the movable member 12 forms a flat surface in the thickness direction of the movable member 12.

Hereinafter, the fabrication process (film formation process) of the movable member 12 will be explained further in detail with reference to FIG. 5.

Figure 5A:
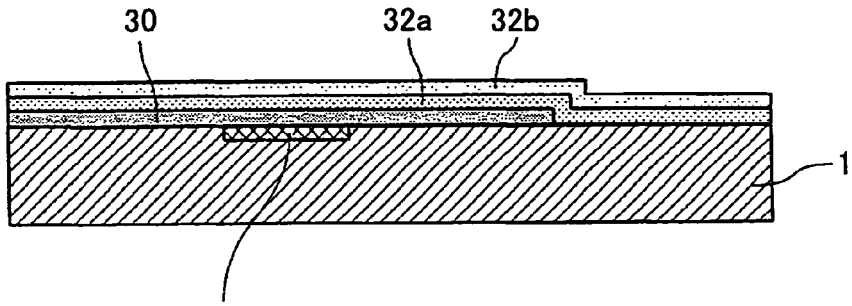
FIGS. 5A-5E are cross-sectional diagrams explaining the manufacturing process of the movable member of FIG. 1.

First, the heating body 10 is formed on the device substrate 1 as shown in FIG. 5A, and an Al film 30 used later as a sacrifice layer is formed on the device substrate 1 including the surface region of the heating body 10 with a predetermined pattern shape. Further, a first p-SiN (plasma-CVD SiN) film 32*a* of silicon nitride is formed thereon by a plasma CVD process with the thickness of about 1.0 μm, and a p-$SiO_2$ (plasma-CVD $SiO_2$) film 32*b* of silicon oxide is formed further on the first p-SiN film 32*a* by a plasma CVD process with the thickness of about 0.5 μm.

Figure 5B:
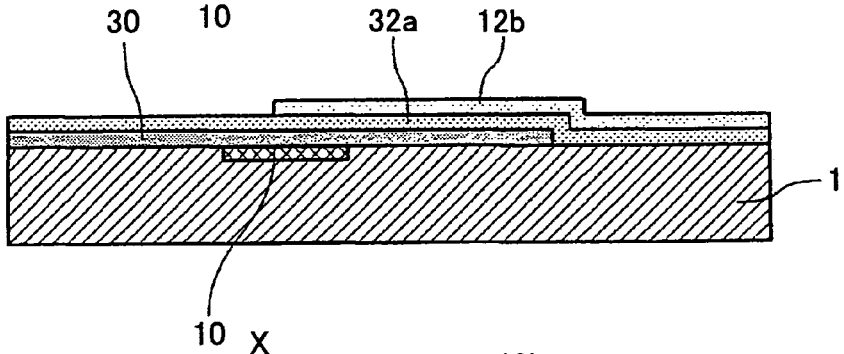
Figure 5C:
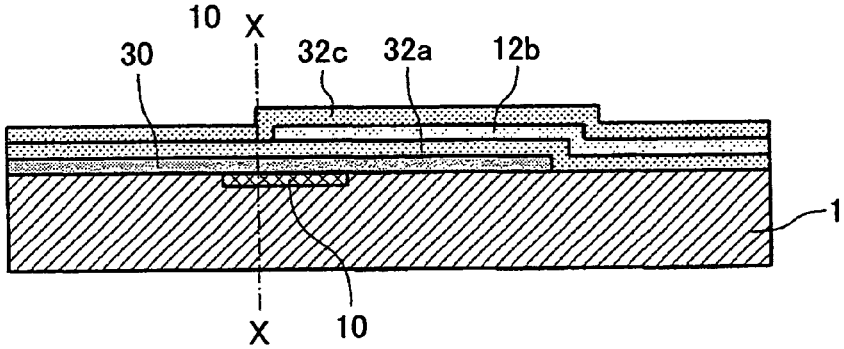

Next, as shown in FIG. 5B, the p-$SiO_2$ film 32*b* is subjected to a patterning process by applying a photolithographic process and etching process to form an intermediate layer 12 in the shape of the movable member 12. Thereafter, in the step of FIG. 5C, the second p-SiN film 32 of silicon nitride is formed with the thickness of about 1.0 μm.

Figure 5D:
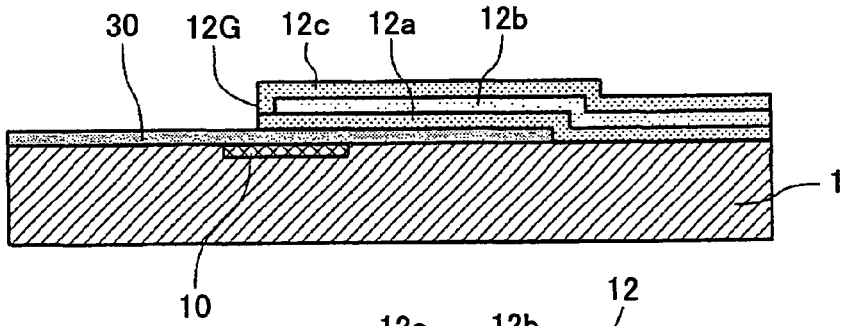

Further, as shown in FIG. 5D, the first and second p-SiN films 32*a* and 32*c* are patterned to a pattern shape larger than the pattern of the intermediate layer 12*b* formed of the p-$SiO_2$ film 32*b* by the size of about 1.0 μm (for example at the location of the line X of FIG. 5C) by applying a photolithographic process and etching process, to form the layers 12*a* and 12*c* on the surface of the movable member 12.

Here, because the layers 12*a* and 12*c* constituting the outermost surface of the movable member 12 are formed of the same material, the amount of the lateral etching at the time of the etching process becomes identical in these layers, and thus, the edge surface 12G of the free end 12F becomes a flat surface in the thickness direction of the movable member 12.

Thus, with the foregoing process, it becomes possible to cover the free end of at least one layer that constitutes the movable member 12 formed of lamination of three or more layers, with the layer constituting the surface layer of the movable member and further to form a flat surface at the edge surface 12G forming the free end of the movable member 12 in the thickness direction of the movable member 12, by forming a part in which two or more layers of the same material are directly overlapped and by etching such a part perpendicularly to the device substrate 1 to form the movable member 12.

It should be noted that, in the case the movable member 12 is formed by etching all of the three layers of two or more materials constituting the laminated body of the movable member in a single etching step, there would inevitably be caused exposure of a layer of the material that has poor durability to the liquid. Further, because of the difference of lateral etching rate between the different materials constituting the laminated body, there would appear a sawtooth shape at the free end of the movable member 12 along the edge part in the thickness direction of the movable member 12.

Further, by laminating the SiN film characterized by a relatively large Young modulus over the $SiO_2$ film of relatively low Young modulus, it becomes possible to interrupt the grain growth within the SiN film, and extensive development of the grain boundary inside the SiN film is eliminated. Thereby, the tolerance of the movable member with regard to the deformation associated with the displacement is increased, and the mechanical strength of the movable member is improved. Thereby, the durability of the movable member is improved. In addition to SiN, it is also possible to use SiC (silicon carbide) for the material of the relatively large Young modulus.

Figure 5E:
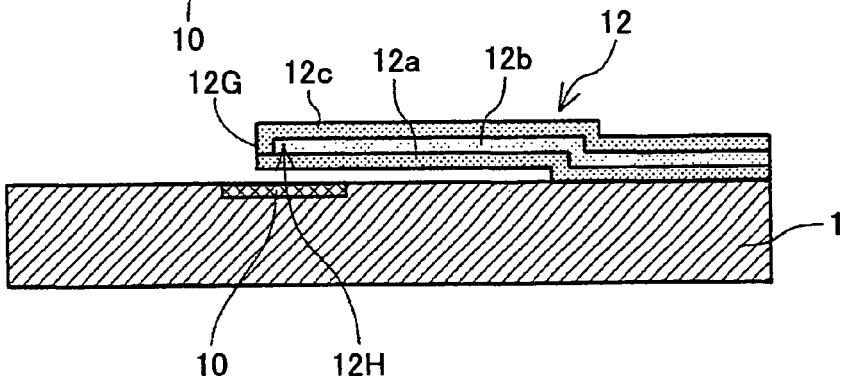

Finally, as shown in FIG. 5E, the Al sacrifice layer 30 on the device substrate 1 is removed by etching, and with this, formation of the movable member 12 of the three-layer structure, in which the intermediate layer 12 is covered by the surface layers 12*a* and 12*c*, is completed.

Thus, with the movable member 12 of the present embodiment, the outer periphery and the edge part of the free end of the movable member 12 are covered with the layer constituting the surface layer of the movable member 12 (the layers 12*a* and 12*c* in the present embodiment). Thereby, the inner layer of the movable member 12 (the layer 12*b* in the case of the present embodiment) does not make a contact with the liquid, and there is caused no corrosion in the inner layer of the movable member even when the movable member is contacted with the liquid.

As a result of the foregoing feature of the present embodiment, there is achieved the effect of increased degree of freedom in choosing the material for the inner layer of the movable member and increased degree of choosing the material for the liquid that is used with the liquid ejection head.

More specifically, by using the construction for the movable member such that the movable member is formed of lamination of three or more layers and such that, at the free end part of the movable member, the edge surface of at least one layer is covered with another layer, the number of the materials constituting the layer(s) that makes a contact with the liquid is reduced. Thereby, there is achieved the effect of increased degree of freedom in choosing the material for the layers constituting the movable member and increased degree of choosing the material for the liquid that is used with the liquid ejection head.

In other words, with the construction for the movable member in which the movable member is formed as a lamination of three of more layers of at least two different materials such that the edge surface of at least one layer forming the free end of the movable member is covered with the layer forming the surface of the movable member, the number of the materials constituting the layers are contacted with the liquid is reduced, and there is achieved the effect of increased degree of freedom in choosing the material for the layers constituting the movable member and increased degree of choosing the material for the liquid that is used with the liquid ejection head.

By covering the edge surface of one layer corresponding to the free end of the movable member with another layer forming the same movable member, there is formed a part in which two layers of the same material are laminated directly. By etching such a directly laminated part, the free end of the movable member can be formed to have a flat edge surface because of the same lateral etching speed for these two, covering layers.

Because the movable member is formed by laminating two or more layers of two or more materials, and because the free end of the movable member has a flat surface free from unwanted sawtooth structure in the thickness direction of the movable member, there occurs no chipping or cracking at such a free end part even when there is applied a mechanical shock with the formation or annihilation of bubbles. Thus, the problems such as variation of ejecting characteristics between among channels formed in the head, or the problems such as the fragment of the movable member formed as a result of the mechanical damages cause clogging or choking of the ejection port or flow passage, are successfully eliminated. Thereby, degradation of printing quality is avoided successfully.

Next, the ejection process of liquid droplet from the foregoing liquid ejection head will be explained with reference to FIGS. 6A-6F.

Figure 6A:
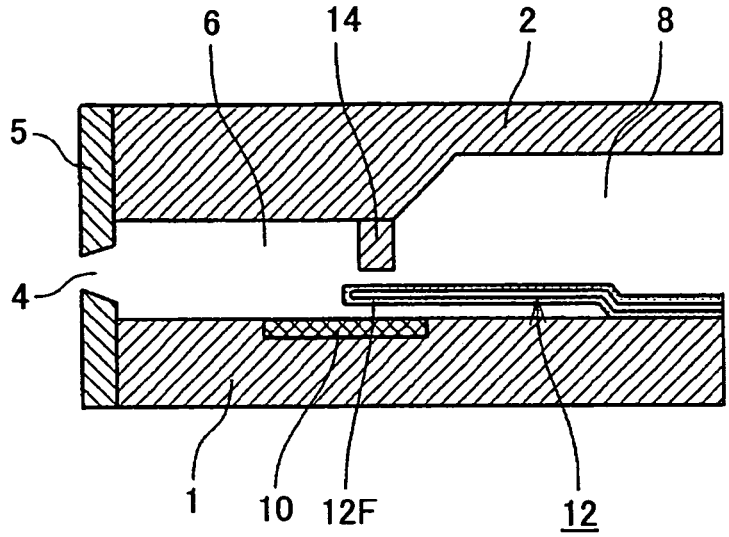
FIGS. 6A-6F are cross-sectional diagrams explaining the ejection operation of the liquid ejection head of FIG. 1.

Referring to FIG. 6A showing the state before the driving energy such as electric energy is applied to the heating body 10, it can be seen that the movable member 12 is in the state so as to face a bubble formation region of the device substrate 1 corresponding to one half part the bubble 16 (upstream-side part) formed thereon in response to energization of the heating body 10.

Figure 6B:
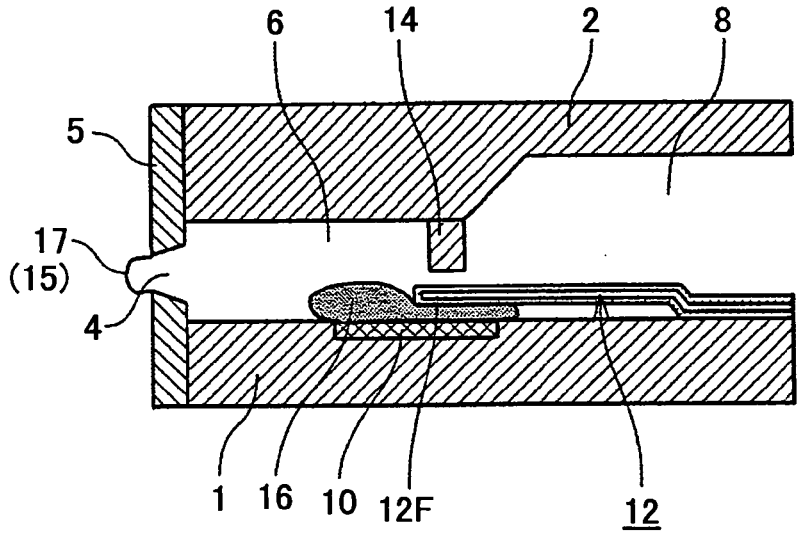

Thus, by energizing the heating body 10, a part of the liquid filling the foregoing bubble formation region undergoes heating, and there appears a bubble 16 as shown in FIG. 6B as a result of boiling of the liquid. Thereby, there is caused a displacement in the movable member 12, while it should be noted that this displacement of the movable body 12 is caused with a delay with regard the dilatational change of the bubble 16.

In more detail, a pressure wave caused by the generation of the bubble 16 in response to the boiling of the liquid propagates through liquid filling the flow passage 6, and associated therewith, the liquid in the flow passage 6 undergoes displacement in the upstream side direction and in the downstream side direction, such that a part of the liquid located at the downstream side with respect to a central region of the bubble formation region is displaced in the downstream side direction while a part of the liquid located at the upstream side with respect to the foregoing central region is displaced in the upstream side direction. Thereby, there starts a displacement of the movable member 12 in the foregoing upstream side as a result of the flow of the liquid caused by the growth of the bubble 16.

In the downstream side, it should be noted that the liquid flows toward the common liquid supply chamber 8 through the narrow passage formed between the passage sidewall (compartment wall) 3 and the movable member 12. Thereby, it should be noted that the clearance between the stopper 14 and the movable member 12 is decreased with increasing displacement of the movable member 12. In this state, there grows a meniscus 15 (liquid 17) so as to project from the ejection port 4.

Figure 6C:
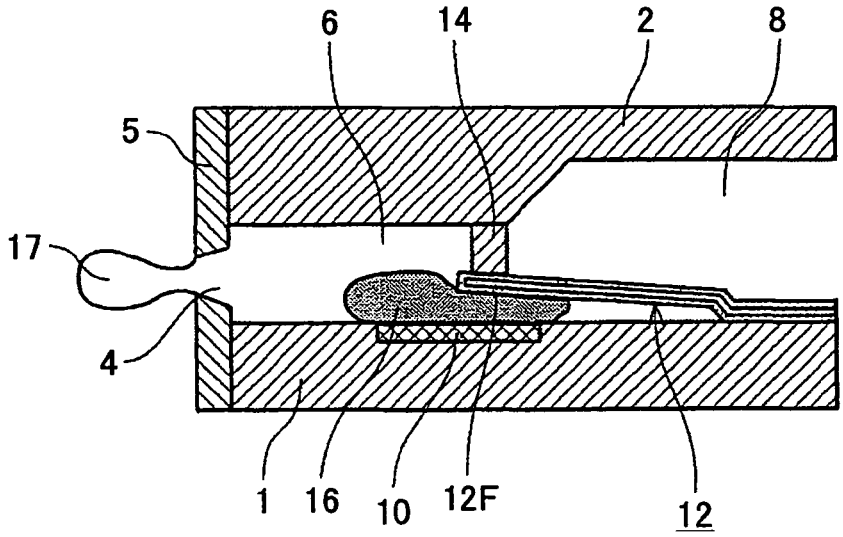

With further growth of the bubble 16, the free end 12F of the movable member 12 engages with the stopper 14 as shown in FIG. 6C, and further displacement of the movable member 12 is restricted. Thereby, the displacement of the liquid in the upstream direction (liquid displacement toward the common liquid supply chamber 8) is also restricted. Thereby, the growth of the bubble 16 in the direction of the upstream side is also restricted, and the dilatational energy of the bubble 16 is used for further growth of the meniscus 17.

Figure 6D:
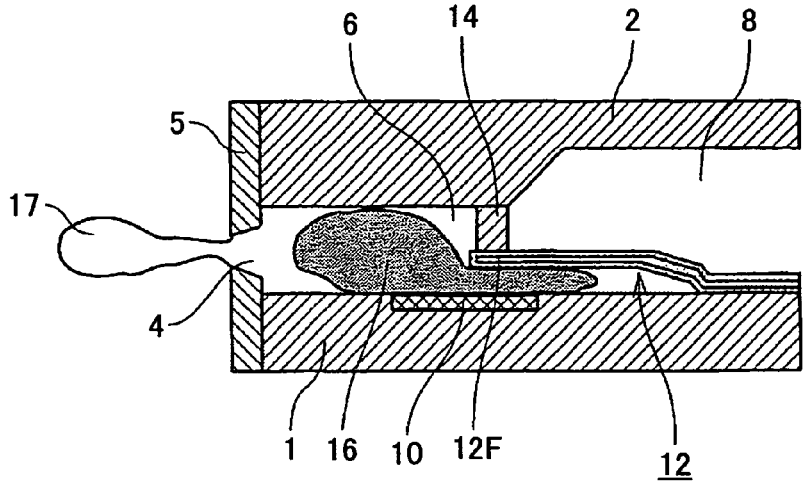
Figure 6E:
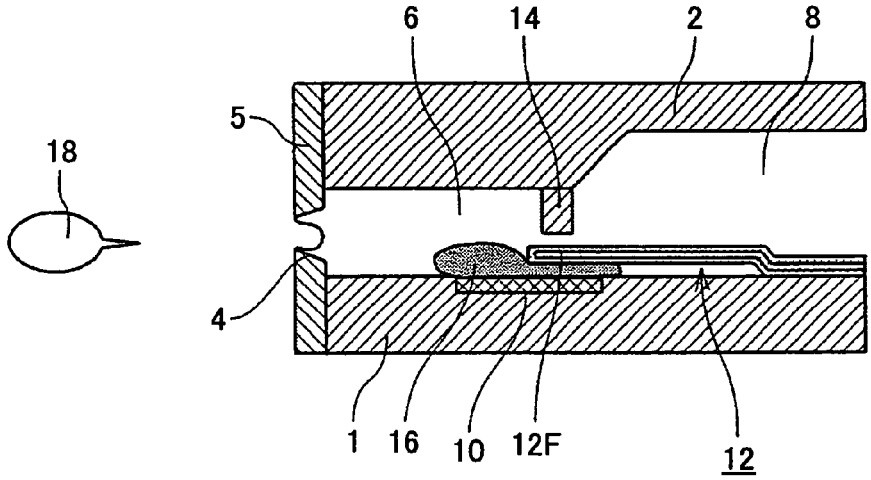

Thus, as shown in FIG. 6D, there is caused further growth of the bubble 16 as shown in FIG. 6D, and the energy of the bubble 16 caused further growth of the meniscus 17.

After the foregoing boiling of the liquid, the negative pressure inside the bubble 16 starts to increase and there occurs a contraction of the bubble 16 when the negative pressure overrides the force causing the displacement of the liquid in the liquid flow passage 6 in the downward-side direction. Associated with the contraction of the bubble 16, the movable member 16 is displaced in the downward direction, while the movable member 2 accumulates therein its own resilient stress of a cantilever and further the deformation stress associated with the bending in the upward direction, and thus, there occurs acceleration in the downward movement of the movable member 12.

With such a downward movement of the movable member 12, the liquid located in the upstream side of the movable member 12 is caused to rush into the liquid flow passage 6 because of the small flow resistance of the liquid in the downstream direction in such a region at the upstream side of the movable member 12, which forms a low flow resistance region between the common liquid supply chamber 8 and the liquid flow passage 6.

Thereby, the liquid in the common liquid supply chamber 8 is directed to the flow passage 6, wherein the liquid thus newly introduced into the liquid passage 6 flows through the gap formed between the stopper 14 and the movable member 12 now in the state deformed in the downward direction into the region at the downstream side of the heating body 10. Thereby, the liquid thus supplied accelerates the annihilation of the bubble 16, which may be still on the way of annihilation.

The liquid thus introduced into the passage 6 further forms a flow toward the ejection part 4 and assists thereby returning of the meniscus and improves the refill speed.

Further, the meniscus 17 protruded from the ejection port 4 forms a droplet 18 in this step, and the droplet 18 thus formed is ejected to the outside of the nozzle 4.

With the liquid ejection head of the present embodiment, the rushing of the liquid into the flow passage 6 via the part between the movable member 12 and the stopper part 14 increases the flow velocity particularly at the side of the top plate 2, and thus, there remain little micro bubbles in such a part. Thereby, the liquid ejection head of the present embodiment achieves stable ejection of the droplet.

In addition to the foregoing, it should be noted that the point of cavitation at the time of the bubble annihilation is displaced in the downward side of the bubble formation region, and because of this, damages to the heating body 10 is reduced substantially. At the same time, the problem of charring of the heating body 10 in such a region is also suppressed, and the ejection of the liquid is stabilized significantly.

Figure 6F:
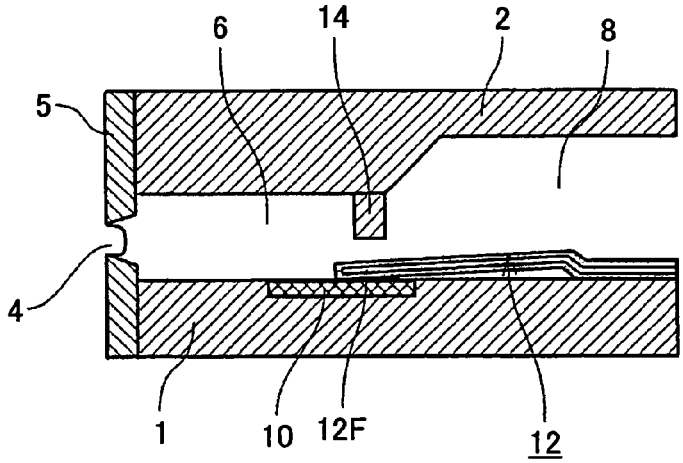

Now, when the bubble 16 is completely annihilated, it should be noted that the movable member 12 causes overshooting in the downward direction with respect to the initial state as shown in FIG. 6F, wherein it should be noted that this overshooting of the movable member 12 settles down within a short time period, although the duration depends on the rigidity of the movable member 12 or the viscosity of the liquid that is used. Thus, the initial state shown in FIG. 6A is reduced in short time.

In the present embodiment, it should be noted that the part of the flow passage 6 located between the ejection port 4 and the downstream side of the bubble 16 is formed to have a straight shape and forms so-called "straight communication." It should be noted that such a construction is used for achieving near ideal droplet ejection characterized by extremely stable ejection characteristics in terms of ejection direction, ejection speed, and the like, as will be noted later, by coinciding the direction of propagation of the pressure wave caused at the time of bubble formation, the direction of the resulting liquid flow and further the droplet ejection direction, in a straight line.

As one approach of realizing this ideal or near-ideal state of droplet ejection, the present embodiment uses the construction in which the ejection port 4 and the heating body 10, particularly the part of the heating body 10 located at the side close to the ejection port 4 (downstream side part of the heating body 10) and providing profound effect on the bubble formation near the ejection port 4, are aligned on a straight line. With this construction, it would become possible to observe the heating body 10, particularly the downstream part of the heating body 10, from outside of the ejection port 4, provided that the flow passage 6 is not filled with the liquid.

With regard to the movable member 12, it is also possible to construct the same by a material other than the one containing silicon as is used in the present embodiment. Such a material may include metals.

On the other hand, the feature of the present embodiment that each of the layers constituting the movable member 12 contains a common element provides an advantageous effect in that adherence between the layers forming the movable member 12 is improved and the risk that the layers of the movable member 12 being separated from each other during the use of the movable member 12 is substantially suppressed.

Second Embodiment

Next, a second embodiment of the present invention will be described with reference to FIG. 7, wherein it should be noted that FIG. 7 explains a movable member 42 according to the second embodiment of the present invention in detail.

Figure 7:
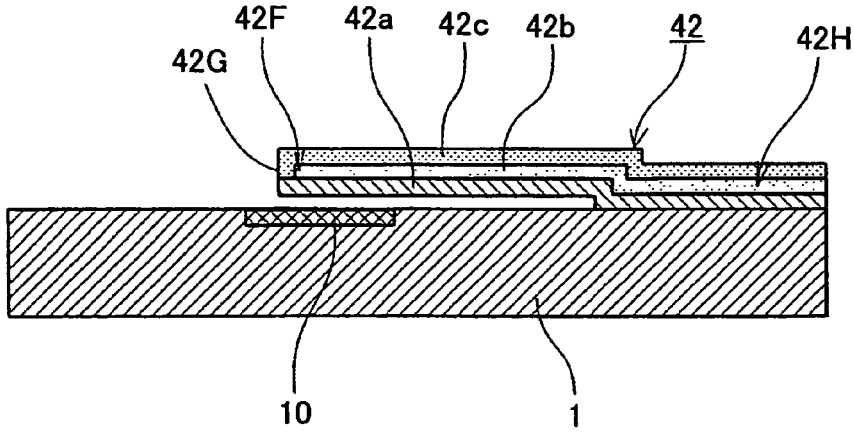
FIG. 7 is a cross-sectional diagram explaining a liquid ejection head according to a second embodiment of the present invention.

Referring to FIG. 7, it will be noted that the movable member 42 of the present embodiment has a three-layer structure in which there are laminated three layers of three, different materials for forming the movable member 42, contrary to the case of the movable member 12 of the first embodiment, in which three layers 12*a*, 12*b* and 12*c* of two different materials are laminated (layers 12*a* and 12*c* are formed of a first material and the layer 12*b* is formed of a second material).

Thus, the movable member 42 is formed of consecutive lamination of the first layer 42*a*, the second layer 42*b* and the third layer 42*c* from the side of the device substrate 1, wherein these first through third layers 42*a*-42*c* are formed of respective, different materials. Further, it should be noted that the end part of the second layer 42*b* at a free end 42B of the movable member 42 is covered with the third layer 42*c* that constitutes the surface layer of the movable member 42. Further, the movable member 42 has fixed end 42H fixed upon the device substrate 1 and the free end 42F that can cause free displacement, wherein the free end 42F is defined by a free-end edge surface 42G.

Thus, while the movable member 42 is formed of lamination of three layers of three different materials, the free end of one layer is covered by another layer that constitutes the surface layer of the movable member 42. In other words, the movable member 42 is formed of lamination of three or more layers of three, different materials, wherein the edge surface thereof at the free end is covered with the first layer of the three layers closest to the device substrate 1 and with the uppermost layer (third layer in the current example).

In this case, too, the number of the materials contacting with the liquid is reduced, and the degree of freedom of choosing the liquid composition or the degree of freedom of choosing the material constituting the layers of the movable member is increased.

Further, because the edge surface at the free end part of the movable member is covered with the two, different materials, and thus, unwanted formation of sawtooth structure at such an edge surface at the time of etching process used for forming the free-end edge surface can be suppressed more or less.

Third Embodiment

Figure 8:
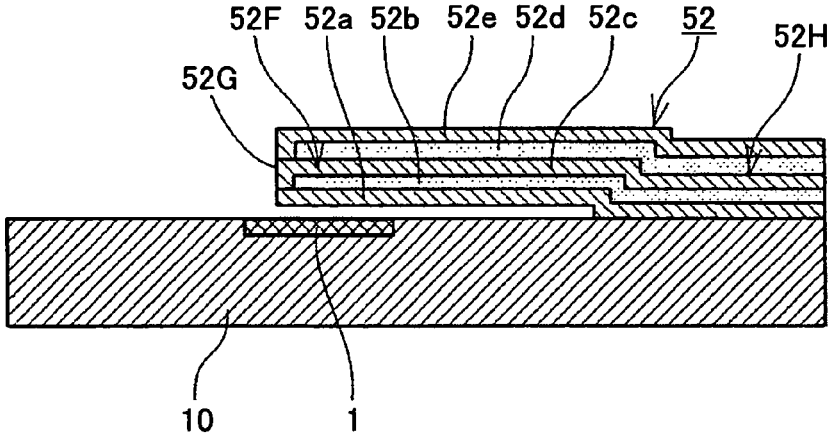
FIG. 8 is a cross-sectional diagram explaining a liquid ejection head according to a third embodiment of the present invention.

Next, a third embodiment of the present invention will be described with reference to FIG. 8, wherein it should be noted that FIG. 8 is a cross-sectional diagram explaining a movable member 52 according to the third embodiment.

It should be noted that the movable body 52 used with the present embodiment has a construction in which two layers of different materials are laminated to form a five-layer structure.

Thus, the movable member 52 is formed by laminating a first layer 52*a*, a second layer 52*b*, a third layer 52*c*, a fourth layer 52*d* and a fifth layer 52*e* consecutively on the device substrate 1, wherein the first layer 52*a*, the third layer 52*c* and the fifth layer 52*e* are formed of the same material, while the second layer 52*b* and the fourth layer 52*d* are formed of the same material different from the material forming the layers 52*a*, 52*c* and 52*e*. Thereby, it should be noted that the respective edge surfaces of the second layer 52*b* and the fourth layer 52*d* at the free end 52B are covered by the fifth layer 52*e* that is an odd number layer as counted from the forgoing first layer 52*a*. Further, this movable member 52 has a fixed end 52H fixed upon the device substrate 1 and a free end 52F, wherein the free end 52F is defined by a flat edge surface 52G.

Thus, by constructing the movable member by lamination of two or more layers of two or more materials and covering the edge surface of the movable member at the free end of the movable member by one of the foregoing layers forming an odd number layer as counted from the layer closest to the device substrate 1, the number of the materials contacting with the liquid is reduced, and the degree of freedom of selecting the liquid or the degree of freedom of selecting the materials used for the layers constituting the movable member 52 is increased.

Further, with the movable member of such a construction, in which the edge surface thereof at the free end part is formed by an etching process, appearance of sawtooth structure at such an edge surface as a result of the etching is prevented, and the problem such as cracking or chipping of the sawtooth part is eliminated with such a movable member even when mechanical shock is applied thereto as a result of formation or annihilation of bubbles. Thereby, the problem of variation of ejection characteristics between different channels or the fragments causing clogging in the ejection port or liquid flow passages are eliminated, and degradation of printing quality can be prevented successfully.

Fourth Embodiment

Figure 9:
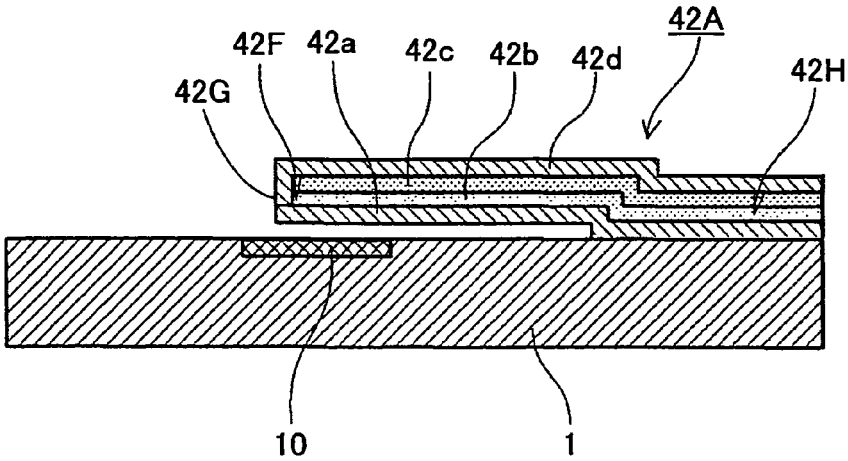
FIG. 9 is a cross-sectional diagram explaining a liquid ejection head according to a fourth embodiment of the present invention.

Next, a fourth embodiment of the present invention will be described with reference to FIG. 9 showing a movable member 42A used with the liquid ejection head of the present embodiment in a cross-sectional view.

Referring to FIG. 9, the movable member 42A has a structure similar to that of the movable member 42 explained with reference to FIG. 7 except that the movable member 42A is now formed of lamination of four layers of three, different materials. Thereby, it should be noted that a fourth layer 42*d* is formed of the same material as the first layer 42*a*.

Thus, the movable member 42A is formed on the device substrate 1 as a result of lamination of the first layer 42*a*, the second layer 42*b*, the third layer 42*c* and the fourth layer 42*d*, wherein the first through third layers 42*a*-42*c* are formed of respective, different materials. Thereby, the edge surfaces of the second and third layers 42*b* and 42*c* at the foregoing free end 42B of the movable member 42 are covered with the fourth layer 42*d*, which is the layer that constitutes the surface of the movable member 42A.

Thus, with the present embodiment, the movable member 42A is formed of lamination of three or more layers of three different materials, and the edge surface 42F thereof at the free end part 42G is covered with the uppermost layer 42*d* (the fourth layer as counted from the first layer 42*a* closest to the device substrate 1).

In this case, too, the number of the materials constituting the layers that cause contact with the liquid is reduced, and the degree of freedom in choosing the material of the liquid or the degree of freedom in choosing the material constituting the movable member can be increased.

Further, because the first layer 42*a* and the uppermost layer 42*d* are formed of the same material with the movable member 42A of the present embodiment, there occurs no such a problem that the edge surface 42G of the movable member 42A at the free end 42F thereof takes a zigzag or sawtooth shape even when end surface 42G of the movable member 42A is formed by an etching process, as such an etching process for etching the layer 42*a* and the layer 42*d* in fact etches only one material.

Because there occurs no formation of sawtooth structure at the free end part of the movable member 42A, there occurs no cracking or chipping in the movable member 42A at the free end part 42F even when there is caused a mechanical shock associated with formation or annihilation of bubble, and the problems such as variation of ejection characteristics between different channels in the head or fragments chipped off from the movable member 42A causing clogging in the droplet ejection port 4 or the liquid flow passages 6. Thus, the problem of degradation of printing quality is successfully eliminated.

Further, in the case of laminating three or more layers with three or more materials, it is possible to use a construction in which the first layer closest to the device substrate 1 and the uppermost layer are formed of different materials, similarly to the case of the second embodiment explained before.

Fifth Embodiment

Next, a liquid ejection head according to a fifth embodiment of the present invention will be described, wherein FIG. 5 is a cross-sectional diagram of the liquid ejection head.

With the liquid ejection head of the present embodiment, it should be noted that there is provided a movable member 62 in which an internal stress is accumulated therein by causing initial bending in a direction away from the heating body 10. Thereby, the movable member 62 is formed of lamination of first through third layers 62*a*-62*c* of respective, different materials, wherein the edge surface of the second layer 62*b* at the side of the free end 62F of the movable member 62 is covered with the third layer 62*c*.

For example, the first layer 62*a* is formed of silicon oxide, the second layer 62*b* is formed of a polysilicon film and the third layer 62*c* is formed of a silicon nitride film. Here, it should be noted that the first layer 62*a* and the second layer 62*b* accumulate therein a compressive stress, while the third layer 62*c* accumulates therein a tensile stress. Thereby, the movable member 62, formed of lamination of the foregoing three layers 62*a*-62*c*, undergoes a bending in the direction away from the heating body 10 in the initial state thereof as shown in FIG. 9, in which a fixed end 62H of the movable member 62 is fixed upon the device substrate 1 and the free end 62F opposite to he foregoing fixed end 62H is displaced in the upward direction.

Figure 10:
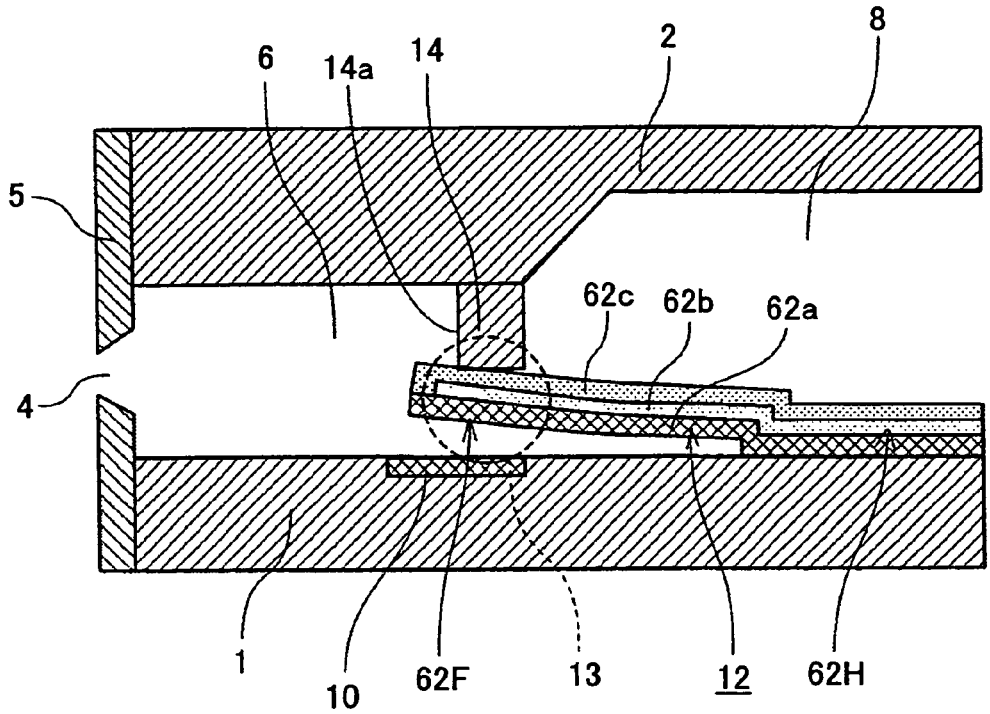
FIG. 10 is a cross-sectional diagram explaining a liquid ejection head according to a fifth embodiment of the present invention.

Thus, it is possible to provide an initial internal stress to the movable member 62 such that the movable member 62 is bent in the direction away from the heating body 10 in the initial state of the movable member 62, by providing a tensile film accumulating therein a tensile stress (third layer 62*c* of SiN in the present case) at the side of the movable member 62 away from the heating member 10. In this case, it is preferable that the free end 62F of the movable member 62 is contacted with the stopper 14 as shown in FIG. 10.

Hereinafter, droplet ejection operation of the liquid ejection head will be described with reference to FIGS. 11A-11F.

Figure 11A:
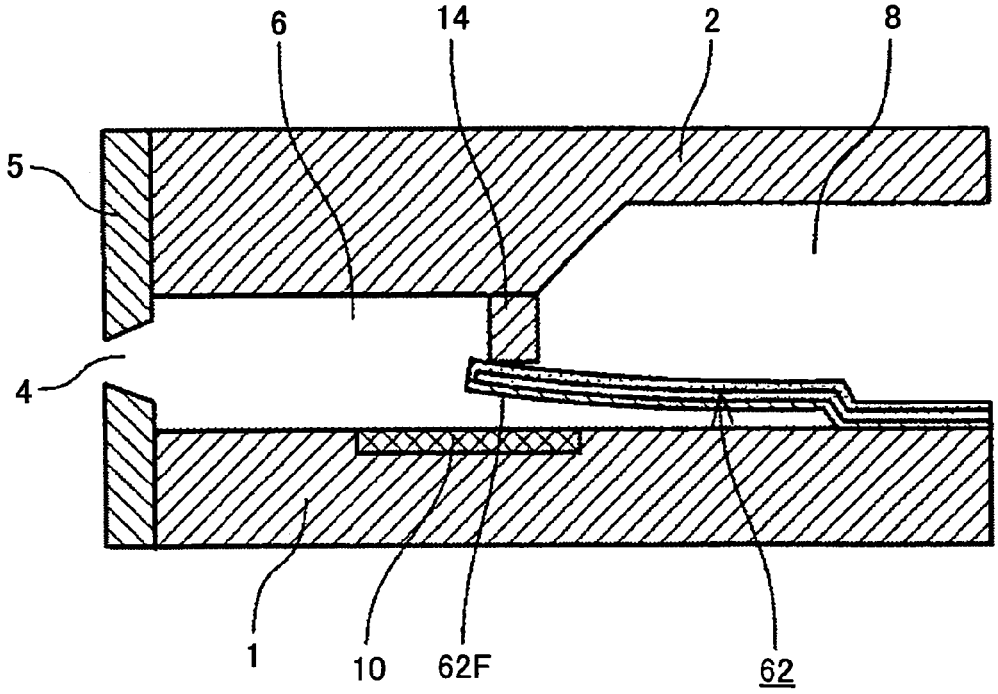
FIGS. 11A-11F are cross-sectional diagrams explaining the ejection operation of the liquid ejection head of FIG. 10.

Referring to FIG. 11A showing the initial state of the liquid ejection head, which is the state before energy such as electric energy is supplied to the heating body 10, it can be seen the movable member 62 is deflected as a result of the initial bending such that the free end 62F makes a contact with the stopper 14.

Figure 11B:
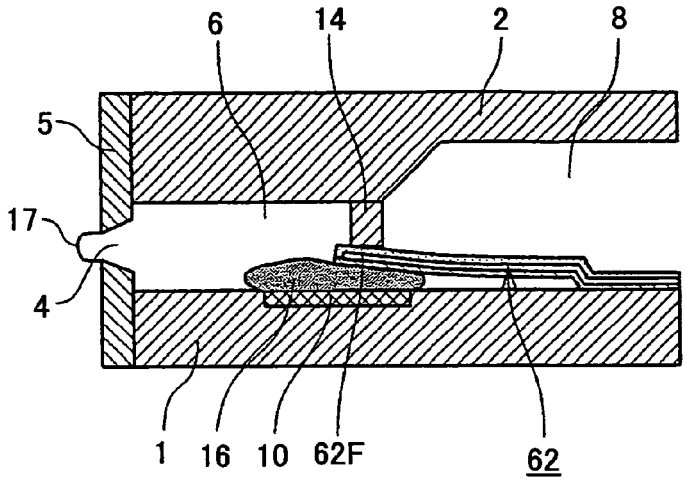

Next, in the step of FIG. 11B, the heating body 10 is energized with electric power, and there starts formation of a bubble in a part of the liquid filling the bubble formation region, as a result of boiling of the liquid caused by the heating of the heating body 10.

Thereby, it should be noted that, because of the initial bending of the movable member 62 in the upward direction, there occurs little displacement in the movable member 62 with the dilatational force of the bubble 16. Further, there occurs little movement of the liquid in the upstream direction (direction toward the common liquid chamber 8) in view of the fact that communication between flow passages 6 defined by compartment walls 3 and the common liquid chamber 8 in the upstream side is closed by the movable member 62.

Figure 11C:
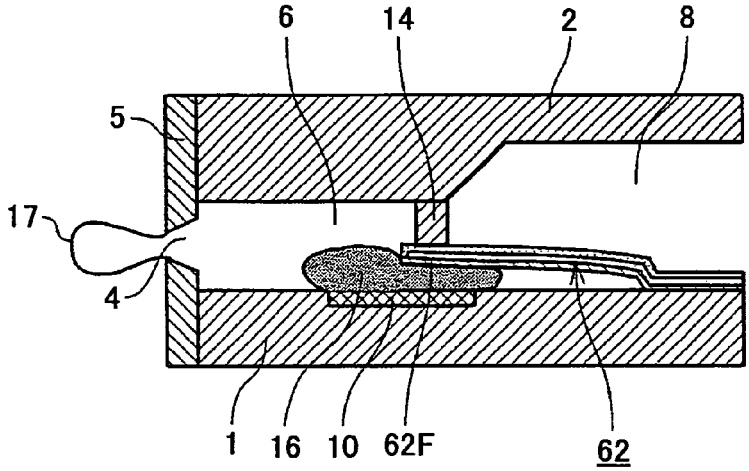

Now, when there is caused further growth of the bubble 16 as shown in FIG. 11C, the part of the movable member 62 not restricted by the stopper 14 undergoes deformation in the upward direction, and the movable member 62 takes a convex shape bulging in the upward reaction.

Figure 11D:
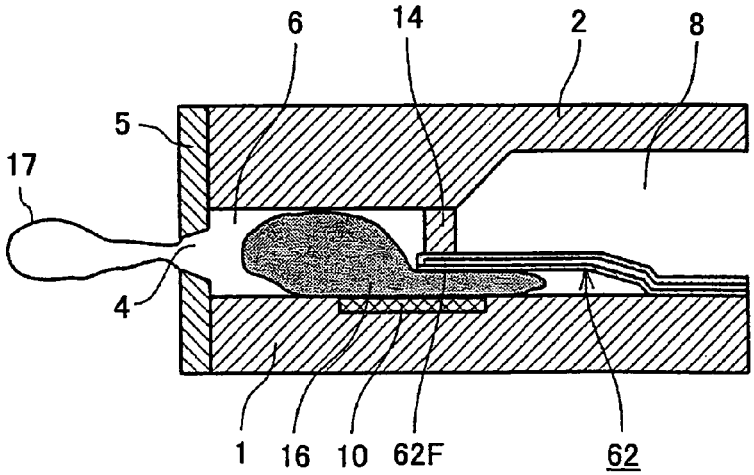

Further, in the step of FIG. 11D, there occurs further growth of the bubble 16, and associated with this, there occurs the growth of the meniscus as a result of the dilatational energy of the bubble 16.

Figure 11E:
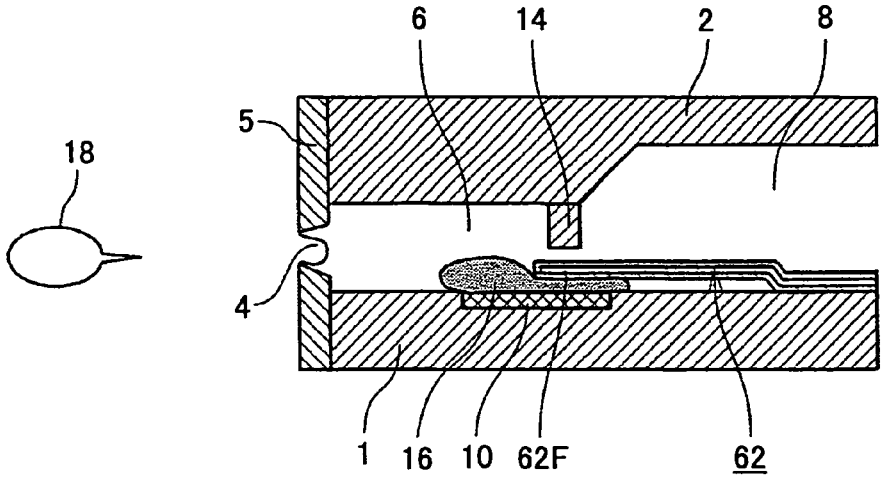

Thereafter, as shown in FIG. 11E, there occurs an increase in the negative internal pressure of the bubble 16 after the boiling of the liquid is over, and the negative pressure of the bubble 16 eventually overrides the movement of the liquid in the liquid flow passage 6 in the downstream direction. Thereby, there is started contraction of the bubble 16.

With the contraction of the bubble 16, the movable member 62 undergoes a displacement in the downward direction, wherein the movable member 62, being a cantilever held upon the device substrate 1 at the fixed end 62H thereof, accelerates the speed of the movement in the downward direction, wherein this downward movement of the movable member 62 is further accelerated by the resilient stress accumulated therein in the state in which it is bulged in the upward direction in the state of FIG. 1D.

After the bubble 16 is completely annihilated as shown in FIG. 11E, the movable member 62 returns to a state close to the initial state and the meniscus 17 is separated from the liquid inside the liquid flow passage 6 in the form of liquid droplet 18, and with this, the liquid droplet 18 thus separated is ejected to the outside of the head.

Figure 11F:
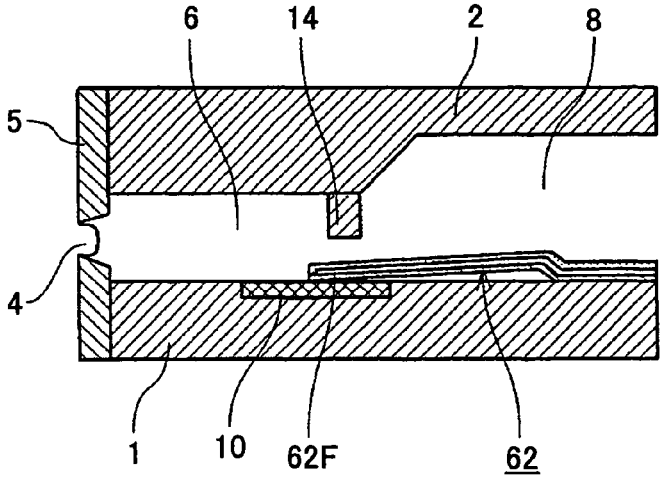

Thereby, the movable member 62 thus returned to the initial state continues its downward movement in the step of FIG. 11F and there occurs overshooting in the movement of the movable member 62. This overshooting continues for the duration determined by the rigidity of the movable member 62, the viscosity of the liquid, or the like, wherein the overshooting is settle down in short time period, and the initial stationary state of FIG. 11A is resumed.

This ejection operation of the liquid ejection head is fundamentally identical with that explained with reference to the first embodiment, except that the liquid flow passage 6 is closed by the movable member 62 and the stopper 14 in the initial state before the driving energy such as the electric energy is provided to the heating body 10.

Thus, with such a construction, the entire dilatational energy of the bubble caused with the dilatation of the bubble in response to the energization of the heating body 10 with the electric energy, is transmitted to the liquid in the direction of the liquid ejection, and a high efficiency is achieved for the ejection of the liquid droplet.

In view of the high efficiency of ejection, the liquid ejection head of the present embodiment can reduce the power consumption, while this leads also to the decrease of heat generation for the heating body 10, and it becomes possible to suppress the temperature rise of the liquid ejection head caused by unnecessary heating. Thereby, driving of the liquid ejection head with high frequency becomes possible, and it becomes possible to construct a liquid ejection head array in which a large number of liquid ejection heads are arranged with high density for simultaneous driving. By using such high-density liquid ejection head array, it becomes possible to form patterns on a medium at very high speed.

Here, it is not always necessary to combine a layer of compressive stress and a layer of tensile stress for providing a preset deflection to the movable member in the upward direction away from the heating body. For example, it is possible to provide the desired initial deflection or bending to the movable member 62 by using various combination of stressed layers such as the combination of the layer of strong compressive stress and the layer of weak or zero compressive stress, the combination of the layer of weak tensile stress or zero stress and the layer of strong tensile stress, and the like.

For the movable member 62, it is possible to use, in addition to the materials of SiN (silicon nitride), silicon oxide and polysilicon mentioned before, durable materials including a metal or metal alloy such as silver, nickel, gold, iron, titanium, aluminum, platinum, tantalum, stainless steel, phosphor bronze, or the like, a resin having a nitrile group such as acrylonitrile, butadiene, styrene, or the like, a resin having an amide group such as polyamide, a resin having a carboxyl group such as polycarbonate, a resin having an aldehyde group such as polyacetal, a resin having a sulfone group such as polysulfone, or other resins such as liquid crystal polymers or their compounds. Further, for the movable member 62, it is possible to use ink-resistant coatings of ink-resistant material such as a metal or alloy of gold, tungsten, tantalum, nickel, stainless steel or titanium, a resin having an amide group such as polyamide, a resin having an aldehyde group such as polyacetal, a resin having a ketone group such as polyether ether ketone, a resin having an imide group such as polyimide, a rein having a hydroxide such as phenolic resin, a resin having an ethyl group such as polyethylene, a resin having an alkyl group such as polypropylene, a resin having an epoxy group such as an epoxy resin, a resin having an amino group such as a melamine resin, a resin having a methylol group such as a xylene resin, or their compounds.

Sixth Embodiment

Figure 12:
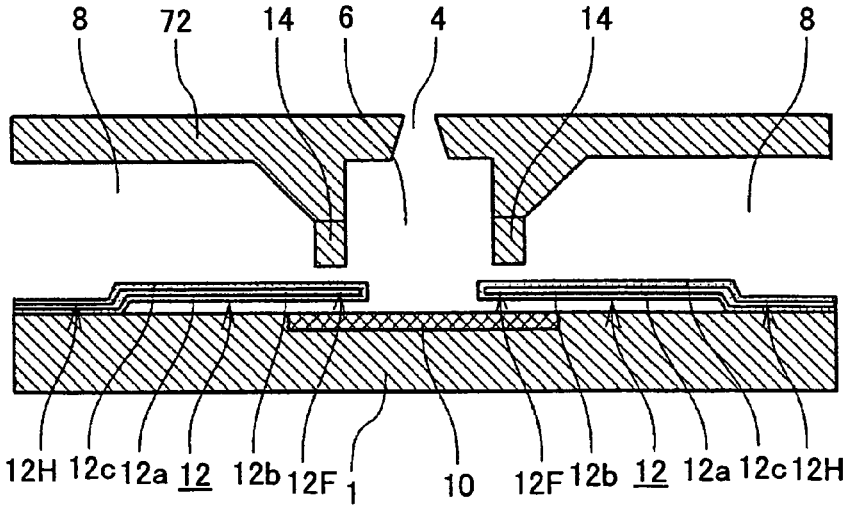
FIG. 12 is a cross-sectional diagram explaining a liquid ejection head according to a sixth embodiment of the present invention.
Figure 13:
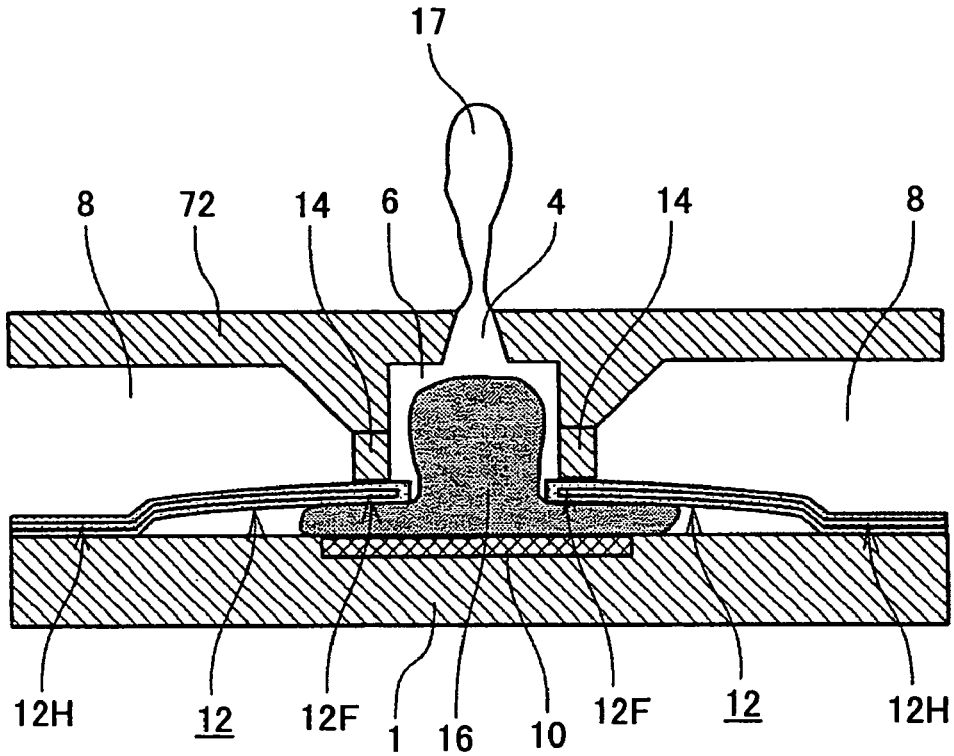
FIG. 13 is a cross-sectional diagram explaining the liquid ejection operation of the liquid ejection head of FIG. 12.

Next, a liquid ejection head according to a sixth embodiment of the present invention will be described with reference to FIG. 12, wherein FIG. 12 is a cross-sectional diagram explaining the liquid ejection head of the present embodiment.

Heretofore, explanation has been made with regard to the liquid ejection head of the edge shooter type, while the present embodiment deals with the liquid ejection head of the side shooter type.

Referring to FIG. 12, the liquid ejection head of the present embodiment is formed by providing a nozzle plate 72 over the device substrate 1 via a compartment wall member (not illustrated) defining the liquid flow passages 6, wherein it should be noted that there are formed a plurality of such liquid flow passages 6 each communicating with a corresponding droplet ejection port 4 formed on the nozzle plate 72, wherein each of the flow passages 6 is formed between the device substrate 1 and the nozzle plate 72 and is accompanied with a pair of large-volume common liquid supply chambers 8 communicating with the flow passage 6 from both lateral directions, wherein the liquid supply chambers 8 are formed also between the device substrate 1 and the nozzle plate 72.

Further, there are provided two movable members 12 respectively in correspondence to the two common liquid supply chambers 8 such that each of the movable member 12 extends from the common liquid supply chamber 8, in which the movable member 12 is provided, to the liquid flow passage 6. Thereby, the movable member 12 is provided such that the free end 12F thereof is located in the liquid flow passage 6, in which the heating body 10 is provided, and hence at the side of the droplet ejection port 4, while the other end 12H is fixed upon the device substrate 1. Thereby, each of the movable members 12 forms a cantilever on the device substrate 1 with the gap 13 formed between. Thereby, the movable member 12 is held in the state that the free end 12F thereof is movable freely in the upward and downward directions. Further, the nozzle plate 72 is formed with the stopper part 14 that restricts further upward movement of the movable member 12.

In the initial state (stationary state), the movable member 12 takes a state extending generally parallel with the device substrate 1 with the gap 13 formed therebetween, such that the free end 12F of the movable member 12 is located in the region of the heating body 10 provided on the device substrate 1 in such a manner that the tip end part of the foregoing free end 12F is slightly offset from the center of the heating body 10 in the direction of the common liquid supply chamber 8 in which the majority of the movable member 12 is provided.

Further, the stopper part 14 is provided on the lower surface of the nozzle plate 72 as a unitary body or separate body and restricts the further upward movement of the free end 12F of the movable member 12 by engaging with the foregoing free end 12F of the movable member 12 in the event the movable member 12 is moved in the upward direction.

Otherwise, the construction of the liquid ejection head of the present embodiment is similar to those of the head explained with reference to the first embodiment, while it is also possible to use the construction of the second through fourth embodiments explained before.

With the liquid ejection head of the present embodiment, it should be noted that movable members 12 at both lateral sides of the flow passage 6 undergoes displacement with the bubble 16, and there occurs growth of the meniscus 17 of the liquid at the ejection port 4.

Thus, by applying the present invention to the liquid ejection head of the side shooter type, it is also possible to achieve the advantageous features of the liquid ejection head of the edge shooter type explained before.

Figure 14:
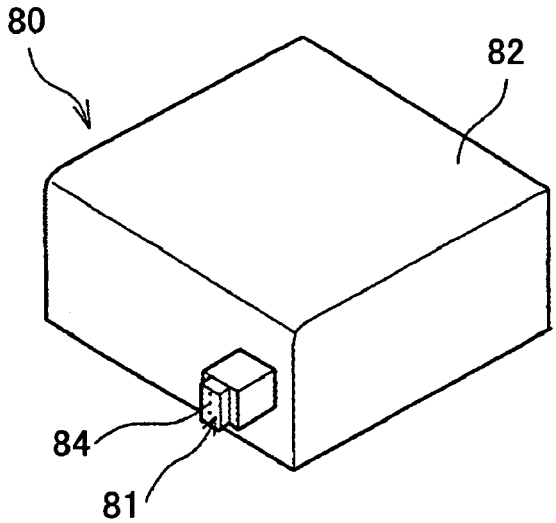
FIG. 14 is a schematic oblique view diagram explaining the construction of a liquid cartridge according to the present invention.

Next, an example of the liquid cartridge of the present invention will be described with reference to FIG. 14, wherein it should be noted that FIG. 14 shows a liquid cartridge 80 of the present invention in a schematic perspective view.

It should be noted that the liquid cartridge 80 includes a liquid ejection head 81 having an ejection port 84 formed by any of the embodiments noted before and a liquid container 82 holding the liquid to be supplied to the liquid ejection head 81. It should be noted that this liquid container can be replenished with a fresh liquid after the liquid therein has been consumed.

With the liquid cartridge 80 thus having the liquid ejection head of any of the embodiments of the present invention, it becomes possible to realize a liquid cartridge in which clogging of the ejection port 84 is reduced and is capable of performing high-speed ejection with driving by using high-frequency.

Figure 15:
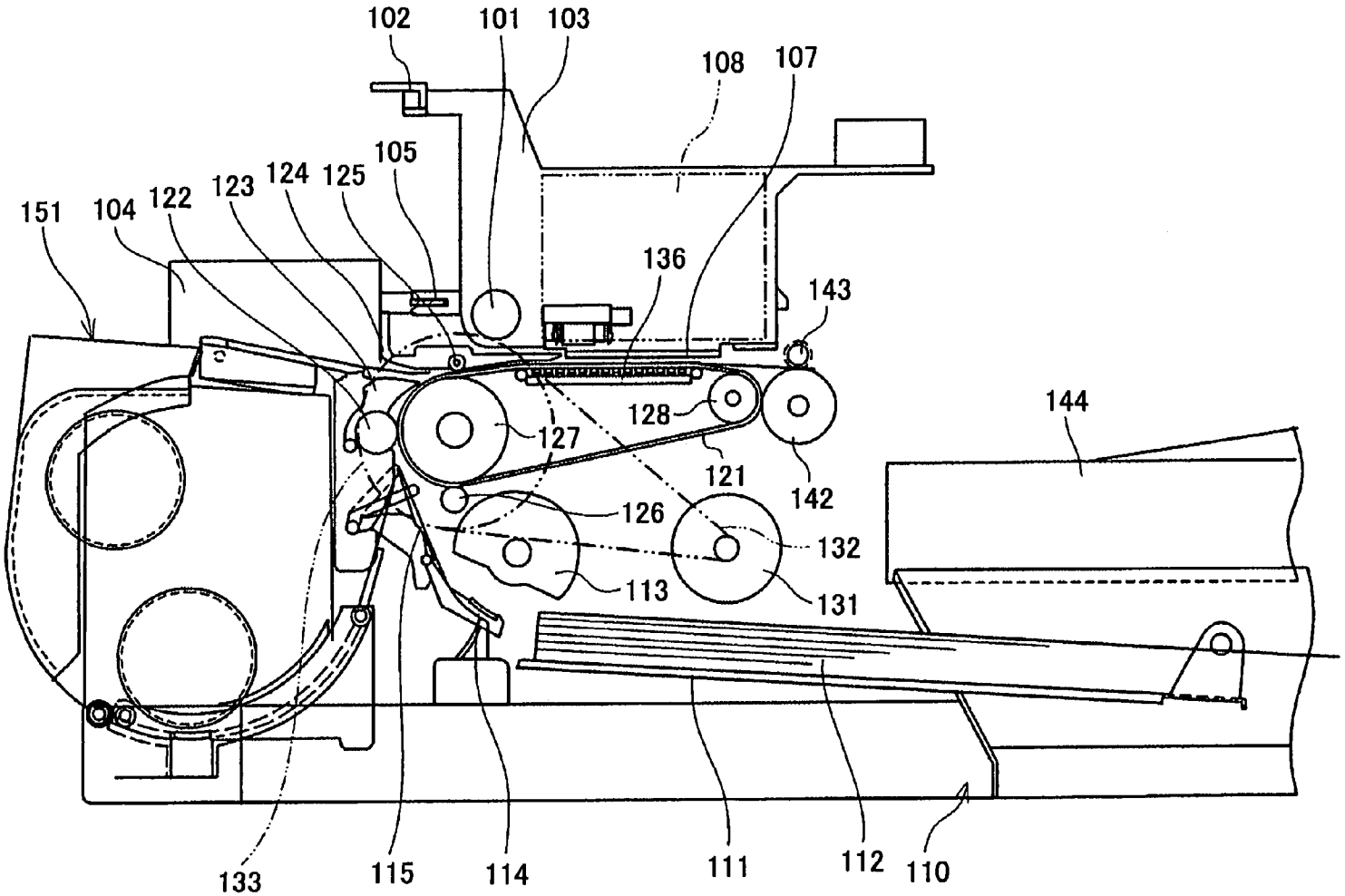
FIG. 15 is a diagram showing the overall construction of the mechanical part of an image forming apparatus that uses the liquid ejection apparatus of the present invention.
Figure 16:
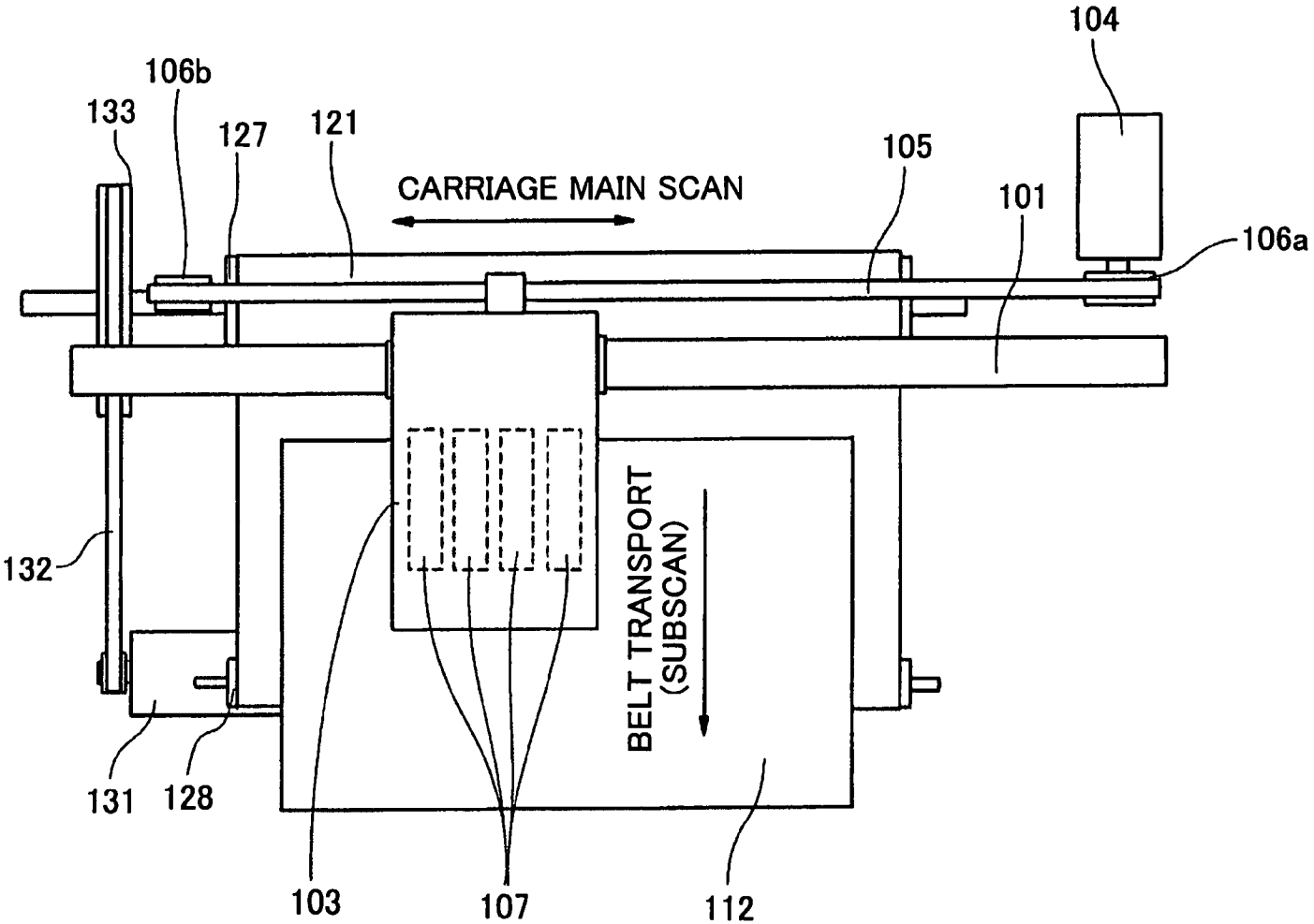
FIG. 16 is a plan view diagram showing a part of the image forming apparatus of FIG. 15.

Next, the image forming apparatus of the present invention that uses the liquid ejection head of any of the preceding embodiments will be described with reference to FIGS. 15 and 16, wherein FIG. 15 is a diagram explaining the overall construction of the image forming apparatus 15, while FIG. 16 is a plan view diagram explaining a part of the image forming apparatus of FIG. 15.

Referring to FIG. 15, the image forming apparatus has the construction of holding a carriage 103 by a guide member including a guide rod 101 bridging across the side plates at the left side and right side and a cooperating stay bolt 102, such that the carriage 103 is movable in the main scanning direction (FIG. 16), wherein the carriage 103 is driven in the main scanning direction by a main scanning motor 104 via a timing belt 105, which is wound around a pulley 106*a* driven by the main scanning motor 104 and another pulley 106*b*.

On this carriage 103, there is mounted a recording head 107 formed of four liquid ejection heads of the present invention respectively ejecting the ink droplets of yellow (Y), cyan (C), magenta (M) and black (Bk), wherein the liquid ejection heads are mounted on the carriage such that the respective ejection ports are directed in the downward direction and the respective ejection ports are aligned in the direction crossing the main scanning direction.

Further, the carriage 103 carries thereon sub tanks 108 for supplying the ink of respective colors to the recording head 107, wherein each of the sub tanks 108 is supplied with the ink from the corresponding main tank (ink cartridge) via an ink feeding tube not illustrated. Of course, it is possible to use a liquid cartridge of integrated heat type.

Further, there is provided a sheet feed part such as a sheet feed cassette 110 for feeding sheets 112 stacked on a pressure plate 111, wherein the sheet feed part includes a feed roller 113 of semi-circular cross section for separating a sheet 112 one by one from the sheet stack for feeding and a separation pad of a material of large friction coefficient disposed so as to oppose the feed roller 113, wherein the separation pad 114 is urged toward the feed roller 113.

Further, in order to transport the sheet 112 thus fed from the sheet feed part 110 such that the sheet 112 is passed under the recording head 107, there is provided a transportation part including a transportation belt 121 sucking the sheet for sheet transportation, a counter roller 122 for transporting the sheet fed from the sheet feed part via a guide 115 so that the sheet is transported in the state in which the sheet is held between the counter roller 122 and the transportation belt 121, a transportation guide 123 that deflects the direction of the sheet 112 fed generally perpendicularly in the upward direction with the angle of about 90 degrees, such that the sheet 112 follows the transportation belt 121, and a pressure roller 125 held by the urging member 124 for urging the sheet 112 to follow the transportation belt 121. Further, there is provided a charging roller 126 for charging the surface of the transportation belt 121.

Here, it should be noted that the transportation belt 121 is an endless belt and spanned between a transportation roller 127 and a tension roller 128. By rotating the transportation roller 127 by a sub-scanning motor 131 via a timing belt 132 and a timing roller 133, the transportation belt 121 is moved in the belt transportation direction (sub-scanning direction, FIG. 16).

This transportation belt 121 comprises a surface layer 21*a* of pure resin having the thickness of about 40 μm not subjected to resistance control, such as the layer of pure ETFE (trademark), and a back layer (intermediate resistance layer or ground layer) formed of the same material as the surface layer 21*a* but is subjected to resistance control by adding carbon thereto and provided under the foregoing surface layer 21*a*, wherein the foregoing surface layer 21*a* is used as the sucking layer of sheet.

Further, the charging roller 126 is disposed so as to make a contact with the surface of the transportation belt 121 and so as to be driven with the movement of the transportation belt 21, wherein there is applied a urging pressure of about. 2.5N at each end of the rotational axis thereof. On the other hand, the transportation roller 127 is grounded and functions also as the grounding roller, wherein the transportation roller 121 makes a contact with the foregoing back layer of the transportation belt 121.

At the rear side of the transportation belt 21, there is disposed a guide member 136 in correspondence to the image transfer region of the recording head 107, wherein it should be noted that this guide member 136 has its top surface projecting in the direction of the recording head 107 across a tangential line of the two rollers (transportation roller 127 and the tension roller 128) spanning the transportation belt 121. With this, the transportation belt 121 is pushed up by the top surface of the guide member 136 in correspondence to the transfer region of the recording head 107 as it is guided over the guide member 136.

Further, in order to discharge the sheet 112 recorded with the recording head 107, the image forming apparatus is provided with a separation part for separating the sheet 112 from the transportation belt 121, sheet discharge rollers 142 and 143, and a tray 144 for collecting the discharged sheets 112.

Further, there may be provided a detachable optional sheet feed unit 151 at the rear side of the image forming apparatus for two-sided recording, wherein it should be noted that this optional sheet feed unit 151 takes up the sheet 112 moved back by the reverse rotation of the transportation belt 121 and supplies the same again between the counter roller 122 and the transportation belt 121 after turning over.

With the image formation apparatus of such a construction, the sheet 112 is separated from the sheet feed part one by one, wherein the sheet 112 fed in the generally upward direction is guided with the guide member 115 and is transported in the state held between the transportation belt 121 and the counter roller 122. Further, the tip end part of the sheet is guided with the transportation guide 123 and the sheet is urged to the transportation belt 121 with the pressure roller 125. Thereby, the transportation direction is changed by about 90 degrees.

In this state, there is applied an alternately changing voltage changing between a plus voltage and a minus voltage to the charging roller 126 from a high voltage source under control of a control circuit not illustrated, and the transportation belt 121 is charged with an alternately changing charging voltage pattern that forms an alternately repeating band-like pattern of predetermined width in the sub-scanning direction in which the transportation belt 121 is circled.

By feeding the sheet 112 on such a transportation belt 121 charged alternately in plus and minus, the sheet 112 is electrostatically attracted to the transportation belt 121 and is transported in the sub-scanning direction with the circulating motion of the transportation belt 121.

Thus, by driving the recording head 107 with an image signal while moving the carriage 103, recording of one line is achieved on the sheet 112 in the stationary state of the sheet 112. After this, the sheet is transported with a predetermined amount for the recording of the next line.

Upon reception of a record end signal or a signal indicating that the rear edge of the sheet has reached the recording region, the image recording apparatus terminates the recording operation and discharges the sheet 112 to the tray 144.

Because the image forming apparatus is equipped with the liquid ejection head of the present invention, there occurs little image degradation caused by clogging of the liquid ejection port, and it becomes possible to achieve high quality printing.

Further, the number of the ink suction operation for resolving the clogging (maintenance operation of the head) can be reduced, and the consumption of the liquid is reduced. Further, because it is possible to perform high-frequency ejection, the image recording apparatus of the present invention can achieve high speed printing.

While description has been made with regard to image formation apparatus in which the liquid ejection heat is used as an ink-jet head, the present invention is by no means limited to such a specific application.

Thus, for the medium on which attachment of liquid such as ink is made, it is possible to use various kinds of papers, OHP sheets, plastics used for example for compact disks or ornament plates, cloths, metals such as aluminum or copper, leathers such as cowhide, pig leather or artificial leather, woods including ply woods, bamboos, ceramics such as tiles, three-dimensional structures such as a sponge, or the like.

Thereby, the liquid ejection apparatus includes various printers recording on various papers or OHP sheets, a plastic recording apparatus recording on a plastic material such as a magnetic disk, a metal recording apparatus recording on a metal plate, leather recording apparatus recording on a leather, wood recording apparatus recording on a wood, ceramics recording apparatus recording on ceramic materials, recording apparatus recording on a three-dimensional network structure such as sponges, and a textile printing apparatus recording on a cloth.

Thereby, the liquid used with these liquid ejection apparatuses is selected according to the medium on which the recording is to be made or the recording condition used for recording.

Figure 17:
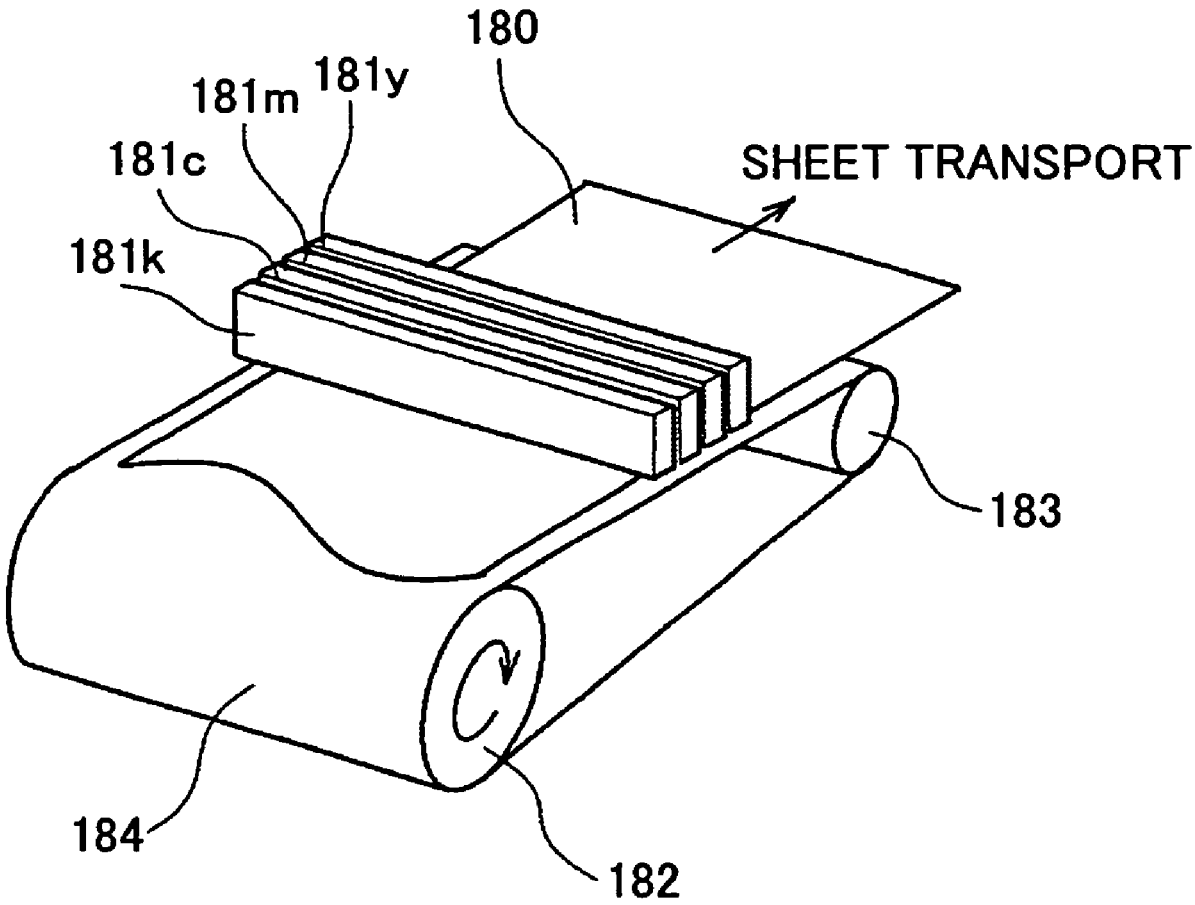
FIG. 17 is an oblique view diagram showing a part of another example of the image forming apparatus that uses the liquid ejecting apparatus of the present invention.

Next, another example of the image formation apparatus of the present invention that includes the liquid ejection apparatus of the present invention will be explained with reference to FIG. 17 showing a schematic perspective view of the apparatus.

Referring to FIG. 17, the image recording apparatus is equipped with full-line heads 181*y*, 181*m*, 181*c* and 181*k* for the liquids of the respective colors, wherein each of the full-line heads includes plural ejection ports disposed in the entire width of the recordable region of the medium 180.

It should be noted that the full-line heads 181*y*, 181*m*, 181*c* and 181*k* are disposed on the transportation path of the recording medium 180 provided by an electrostatic transportation belt 184 spanned between a transportation roller 182 and a tension roller 183 so as to cross the transportation path, and achieves simultaneous recording on the entire width of the recordable region of the medium 180.

With such a full-line image forming apparatus, there tends to arise a problem, when recording on a thin paper or ordinary paper, in that the recording sheet makes a contact with the head because of the winkle caused by swelling of the paper, which in turn is caused by penetration of the ink. Such winkling of the sheet can be suppressed by using high viscosity ink such that penetration of the ink into the paper is suppressed. Further, with the full-line image forming apparatus, in which the printing is achieved in one, single scan, it is necessary to use a head in which nozzles and the flow passages are arranged with high density for the recording head.

With the liquid ejection head of the present invention, it becomes possible to arrange the flow passages in high density and at the same time use a high viscosity ink. Thus, the present invention is particularly effective in the full-line recording head or full-line-type apparatus using such a full ring recording head.

In a full-line image forming apparatus or liquid ejection apparatus, there appears a remarkable streak when there is caused a clogging in one of the ejection ports, while such remarkable streak causes severe degradation of image quality. With the use of the liquid ejection head of the present invention, the problem of clogging of the ejection port is resolved, and the degradation of images with the white streaks is reduced. Thereby, remarkable improvement of image quality is attained.

Further, with the full-line type apparatus, a large amount of ink is consumed when a suction operation is made for recovering the clogging. By using the liquid ejection head of the present invention, there is achieved significant improvement over this problem of waist of ink. Further, because the full-line head of the present invention can be driven with high frequency, a faster printing can be achieved.

Further, the present invention is by no means limited to the embodiments described heretofore, but various variations and modifications may be made without departing from the scope of the invention.

INDUSTRIAL APPLICABILITY

According to the liquid ejection head of the present invention, in which the movable member is constructed by laminating three or more layers such that the free edge of at least one layer thereof is covered by another layer, the number of the materials constituting the layers contacting with the liquid is reduced, and the degree of freedom of choosing the liquid or the degree of freedom of choosing the material for the movable member is increased.

Further, according to the liquid ejection head of the present invention, in which the movable member is constructed by laminating three or more layers of at least two, different materials, such that the free edge surface of at least one layer is covered with the layer constituting the surface of the movable member, the number of the materials constituting the layers that make a contact with the liquid is reduced, and the degree of freedom of choosing the liquid, or the degree of freedom of choosing the layer constituting the movable member is increased.

According to the liquid ejection head of the present invention, in which the movable member is formed of lamination of two or more layers of two, different materials and in which the free edge thereof is covered with the layer of the odd number as counted from the layer located closest to the device substrate, the number of the materials constituting the layer that makes a contact with the liquid is reduced, and the degree of freedom of choosing the liquid or the degree of freedom of choosing the layer constituting the movable member is increased.

According to the liquid ejection head of the present invention, in which the movable member is formed of lamination of two or more layers of two, different materials and in which the movable member has a flat surface at the free edge thereof, there is formed no sawtooth structure at the free edge of the movable member in the thickness direction thereof, and thus, the problem of formation of cracks in such a movable member is successfully eliminated. Thereby the problems such as instability of ejecting characteristics between the channels or clogging of the ejection port or liquid passage by the fragments are eliminated, and degradation of print quality is successfully avoided.

According to the liquid ejection head of the present invention, in which the movable member is provided with an initial flexure in the side opposite to the heater, the dilatational energy associated with the growth of the bubbles is transmitted solely in the liquid ejection direction, and the efficiency of ejection is improved. Thereby, the power consumption is reduced, and the increase of the head temperature is avoided.

According to any of the liquid cartridge, liquid injection apparatus or image forming apparatus of the present invention, the foregoing advantageous effects are achieved as a result of the use of any of the liquid ejection heads of the present invention noted before therein.

Further, according to the manufacturing method of the liquid ejection head of the present invention, in which there is formed, at the time of laminating plural layers constituting the movable member consecutively, a part in which two or more layers of the same material are directly contacted, and in which the foregoing part where the two or more layers of the same material are directly contacted is etched, it becomes possible to manufacture the liquid ejecting head of the present invention with a simple process.

The invention claimed is:

1. A liquid ejection head, comprising;

an ejection port for ejecting a liquid;

a flow passage communicating with said ejection port;

a device substrate provided with a heating body for forming a bubble in said liquid filled in said flow passage; and a movable member provided on said device substrate in a state such that a first end thereof is fixed upon said device substrate and a free end at an opposite end of said movable member is in a freely movable state, said movable member being provided so as to face said heating body such that there is formed a gap between said movable member and said device substrate, said movable member causing a displacement upon ejection of said liquid from said ejection port as a result of a pressure caused by formation of said bubble, wherein said movable member is constructed by lamination of three or more layers, an end surface of at least one layer of said movable member being covered, at said free end, by another layer of said three or more layers.

2. The liquid ejection head as claimed in claim 1, wherein said end surface of said movable member at said free end forms a flat surface.

3. The liquid ejection head as claimed in claim 1, wherein said movable member has an initial bending in a direction opposite to said heating body.

4. A liquid ejection head, comprising:

an ejection port for ejecting a liquid;

a flow passage communicating with said ejection port;

a device substrate provided with a heating body for forming a bubble in said liquid filled in said flow passage; and a movable member provided on said device substrate in a state such that a first end thereof is fixed upon said device substrate and a free end at an opposite end of said movable member is in a freely movable state, said movable member being provided so as to face said heating body such that there is formed a gap between said movable member and said device substrate, said movable member causing a displacement upon ejection of said liquid from said ejection port as a result of a pressure caused by formation of said bubble, said movable member comprising lamination of at least three layers of two, different materials, an end surface of at least one layer of said movable member being covered, at said free end, by a layer forming an outermost layer of said movable member.

5. The liquid ejection head as claimed in claim 4, wherein said end surface of said movable member at said free end forms a flat surface.

6. The liquid ejection head as claimed in claim 4, wherein said movable member has an initial bending in a direction opposite to said heating body.

7. A liquid ejection head, comprising:

an ejection port for ejecting a liquid;

a flow passage communicating with said ejection port;

a device substrate provided with a heating body for forming a bubble in said liquid filled in said flow passage; and a movable member provided on said device substrate in a state such that a first end thereof is fixed upon said device substrate and a free end at an opposite end of said movable member is in a freely movable state, said movable member being provided so as to face said heating body such that there is formed a gap between said movable member and said device substrate, said movable member causing a displacement upon ejection of said liquid from said ejection port as a result of a pressure caused by formation of said bubble, said movable member comprising lamination of two or more layers of two, different materials, said lamination including a first layer closest to said device substrate, an end surface of said movable member being covered, at said free end, by a layer of an odd number order as counted from said first layer.

8. The liquid ejection head as claimed in claim 7, wherein said end surface of said movable member at said free end forms a flat surface.

9. The liquid ejection head as claimed in claim 7. wherein said movable member has an initial bending in a direction opposite to said heating body.

10. A liquid ejection head, comprising:

an ejection port for ejecting a liquid;

a flow passage communicating with said ejection port;

a device substrate provided with a heating body for forming a bubble in said liquid filled in said flow passage; and a movable member provided on said device substrate in a state such that a first end thereof is fixed upon said device substrate and a free end at an opposite end of said movable member is in a freely movable state, said movable member being provided so as to face said heating body such that there is formed a gap between said movable member and said device substrate, said movable member causing a displacement upon ejection of said liquid from said ejection port as a result of a pressure caused by formation of said bubble, said movable member comprising lamination of three or more layers of three, different materials, an edge surface of said movable member being covered, at said free end, said lamination including a first layer closest to said device substrate, an edge surface of said movable member being covered by an uppermost layer forming said lamination and formed of a material identical with a material constituting said first layer.

11. The liquid ejection head as claimed in any of claim 10, wherein said edge surface of said movable member at said free end forms a flat surface.

12. The liquid ejection head as claimed in claim 10. wherein said movable member has an initial bending in a direction opposite to said heating body.

13. A liquid ejection head, comprising:

an ejection port for ejecting a liquid;

a flow passage communicating with said ejection port;

a device substrate provided with a heating body for forming a bubble in said liquid filled in said flow passage; and a movable member provided on said device substrate in a state such that a first end thereof is fixed upon said device substrate and a free end at an opposite end of said movable member is in a freely movable state, said movable member being provided so as to face said heating body such that there is formed a gap between said movable member and said device substrate, said movable member causing a displacement upon ejection of said liquid from said ejection port as a result of a pressure caused by formation of said bubble, said movable member comprising lamination of two or more layers of two or more materials, said movable member having a flat end surface at said free end.

14. The liquid ejection head as claimed in claim 13, wherein said movable member has an initial bending in a direction opposite to said heating body.

15. A liquid ejection head, comprising:

an ejection port for ejecting a liquid;

a flow passage communicating with said ejection port;

a device substrate provided with a heating body for forming a bubble in said liquid filled in said flow passage; and a movable member provided on said device substrate in a state such that a first end thereof is fixed upon said device substrate and a free end at an opposite end of said movable member is in a freely movable state, said movable member being provided so as to face said heating body such that there is formed a gap between said movable member end said device substrate, said movable member causing a displacement upon ejection of said liquid from said ejection port as a result of a pressure caused by formation of said bubble, said movable member having an initial bending in a direction opposite to said heating body.

16. The liquid ejection head as claimed in claim 15, wherein said movable member engages with a stopper part provided at a side opposite to said heating body in an initial state of said movable member.

17. The liquid ejection head as claimed in claim 15, wherein said movable member carries a tensile film at a side thereof opposite to a side of said heating body.

18. A liquid cartridge comprising a liquid ejection head and a liquid container containing a liquid to be supplied to said liquid ejection head, said liquid container forming a unitary body with said liquid ejection head, said liquid ejection head, comprising:

an ejection port for ejecting a liquid;

a flow passage communicating with said ejection port;

a device substrate provided with a heating body for forming a bubble in said liquid filled in said flow passage; and a movable member provided on said device substrate in a state such that a first end thereof is fixed upon said device substrate and a free end at an opposite end of said movable member is in a freely movable state, said movable member being provided so as to face said heating body such that there is formed a gap between said movable member and said device substrate, said movable member causing a displacement upon ejection of said liquid from said ejection port as a result of a pressure caused by formation of said bubble, wherein said movable member is constructed by lamination of three or more layers, an end surface of at least one layer of said movable member being covered, at said free end, by another layer of said three or more layers.

19. The liquid ejection apparatus for ejecting a liquid from a liquid ejection head, said liquid ejection apparatus comprising a liquid ejection head comprising:

an ejection port for ejecting a liquid;

a flow passage communicating with said ejection port;

a device substrate provided with a heating body for forming a bubble in said liquid filled in said flow passage; and a movable member provided on said device substrate in a state such that a first end thereof is fixed upon said device substrate and a free end at an opposite end of said movable member is in a freely movable state, said movable member being provided so as to face said heating body such that there is formed a gap between said movable member and said device substrate, said movable member causing a displacement upon ejection of said liquid from said ejection port as a result of a pressure caused by formation of said bubble, wherein said movable member is constructed by lamination of three or more layers, an end surface of at least one layer of said movable member being covered, at said free end, by another layer of said three or more layers.

20. An image forming apparatus for forming an image on a recording medium by ejecting a liquid from a liquid ejection head, said image forming apparatus comprising any of a liquid ejection head comprising:

an ejection port for ejecting a liquid;

a flow passage communicating with said ejection port;

a device substrate provided with a heating body for forming a bubble in said liquid filled in said flow passage; and a movable member provided on said device substrate in a state such that a first end thereof is fixed upon said device substrate and a free end at an opposite end of said movable member is in a freely movable state, said movable member being provided so as to face said heating body such that there is formed a gap between said movable member and said device substrate, said movable member causing a displacement upon ejection of said liquid from said ejection port as a result of a pressure caused by formation of said bubble, wherein said movable member is constructed by lamination of three or more layers, an end surface of at least one layer of said movable member being covered, at said free end, by another layer of said three or more layers.

21. A method of manufacturing a liquid ejection head, said liquid ejection head comprising: an ejection port for ejecting a liquid; a flow passage communicating with said ejection port; a device substrate provided with a heating body for forming a bubble in said liquid filled in said flow passage; and a movable member provided on said device substrate in a state such that a first end thereof is fixed upon said device substrate and a free end at an opposite end of said movable member is in a freely movable state, said movable member being provided so as to face said heating body such that there is formed a gap between said movable member and said device substrate, said movable member causing a displacement upon ejection of said liquid from said ejection port as a result of a pressure caused by formation of said bubble, wherein said movable member is constructed by lamination of three or more layers, an end surface of at least one layer of said movable member being covered, at said free end, by another layer of said three or more layers, said method comprising the steps of forming a part in which two or more layers of a same material are directly laminated; and etching said part.

* * * * *